US009695528B1

(12) United States Patent
Smith

(10) Patent No.: US 9,695,528 B1
(45) Date of Patent: Jul. 4, 2017

(54) MULTIPURPOSE PORTABLE MINI LOOM

(71) Applicant: Purl & Loop LLC, Houston, TX (US)

(72) Inventor: Angela Smith, Houston, TX (US)

(73) Assignee: Purl & Loop LLC, Houston, TX (US)

( * ) Notice: Subject to any disclaimer, the term of this patent is extended or adjusted under 35 U.S.C. 154(b) by 0 days.

(21) Appl. No.: 15/081,846

(22) Filed: Mar. 26, 2016

(51) Int. Cl.
*D03D 49/02* (2006.01)
*D03D 29/00* (2006.01)

(52) U.S. Cl.
CPC ..... *D03D 29/00* (2013.01)

(58) Field of Classification Search
CPC ..... D03D 29/00; D03D 49/02; D04B 3/00
See application file for complete search history.

(56) References Cited

U.S. PATENT DOCUMENTS 2,065,498 A * 12/1936 Bacheller ..... D03D 41/00 28/151
2,072,668 A * 3/1937 Eltgroth ..... D04B 17/00 66/4
2,077,532 A * 4/1937 Rossiter ..... D03D 29/00 139/33
2,088,455 A * 7/1937 Witt ..... D04D 7/10 28/150
2,186,692 A * 1/1940 Boyer ..... D03D 29/00 139/34
2,227,550 A * 1/1941 Moore ..... D03D 29/00 28/152
2,270,619 A * 1/1942 Bowyer ..... D04B 39/00 66/4
2,318,018 A * 5/1943 Semonsen ..... D04B 39/00 66/4
2,409,743 A * 10/1946 Durrin ..... D03D 29/00 28/150
2,427,093 A * 9/1947 Eckert ..... D03D 29/00 139/34

(Continued)

FOREIGN PATENT DOCUMENTS

DE 202004008574 10/2004

OTHER PUBLICATIONS

Purl & Loop LLC—"Mini Weaving Loom Kit" archive screenshots of applicant's website, www.purlandloop.com dated Nov. 26, 2013. 3 pages.

(Continued)

*Primary Examiner* — Bobby Muromoto, Jr.
(74) *Attorney, Agent, or Firm* — Gordon G. Waggett, P.C.

(57) ABSTRACT

Disclosed is a portable mini loom utilizing a base section having opposed first and second end edges defining an overall length, a first Ends Per Inch (EPI) zone disposed proximate the base first end edge and extending inwardly along a desired length of the base, and a second EPI zone disposed proximate the base second end edge and extending inwardly along a desired length of the base. Each EPI zone preferably utilizes three separate EPI arrays, of differing EPI, capable of permitting a weaver to select one of such EPI arrays to create a thread warp of a predefined EPI, such as, 8, 10 or 12 EPI. One array utilizes slots disposed along the ends of the base capable of receiving the warp thread. The other two arrays comprise separate sets of through holes disposed across the EPI zone each capable of receiving the warp thread.

26 Claims, 19 Drawing Sheets

(56) References Cited

U.S. PATENT DOCUMENTS 2,450,067 A * 9/1948 Wolff ..... D04B 39/00 66/4
2,609,676 A * 9/1952 Woroneski ..... D04G 3/02 66/4
2,654,937 A * 10/1953 Smith ..... D03D 29/00 28/152
2,663,066 A * 12/1953 Berger ..... D03D 29/00 28/152
2,691,878 A * 10/1954 Boxer ..... D04B 39/00 66/4
2,703,482 A * 3/1955 Auran ..... D04B 3/00 66/4
2,726,434 A * 12/1955 Knoblock ..... D03D 29/00 28/149
2,780,854 A * 2/1957 Dritz ..... D03D 29/00 139/34
3,054,277 A * 9/1962 Broschard ..... D04B 3/00 242/157 R
3,220,439 A * 11/1965 Davis ..... D03D 29/00 28/152
D204,442 S * 4/1966 Brawley ..... D15/66
3,294,124 A * 12/1966 Berger ..... D03D 29/00 28/152
3,636,987 A * 1/1972 Forby ..... D03D 29/00 28/151
3,678,709 A * 7/1972 Nowicki ..... D04B 39/00 66/4
3,688,357 A * 9/1972 Nielsen ..... D03D 29/00 28/149
3,695,303 A * 10/1972 Dunn ..... D03D 29/00 28/152
3,708,839 A * 1/1973 Prince ..... D03D 29/00 28/150
3,724,041 A * 4/1973 Cleverley ..... D04D 11/00 139/34
3,739,437 A * 6/1973 Alberici ..... D03D 29/00 139/34
3,748,706 A * 7/1973 Doyel ..... D03D 29/00 28/150
3,800,372 A * 4/1974 Daoust ..... D03D 29/00 28/152
3,827,091 A * 8/1974 Hocevar ..... D04D 5/00 28/149
D238,812 S * 2/1976 Fioretty ..... D15/78
4,072,173 A * 2/1978 Markowitz ..... D03D 29/00 139/34
4,077,436 A * 3/1978 Kliot ..... D03D 29/00 139/34
4,109,355 A * 8/1978 Davitian ..... D03D 29/00 28/151
4,158,296 A * 6/1979 Dunlop ..... D04B 5/00 66/4
4,248,063 A * 2/1981 Wang ..... D04B 3/00 66/4
RE30,656 E * 6/1981 Davitian ..... D03D 29/00 28/151
4,393,668 A * 7/1983 Leach, Sr. ..... D04B 5/00 66/4
D273,588 S * 4/1984 Barrett ..... D15/66
4,787,219 A * 11/1988 Sato ..... B29C 70/24 66/190
4,881,381 A * 11/1989 Townsend ..... D04B 39/00 28/149
D310,672 S * 9/1990 Harvey ..... D15/66
5,542,268 A * 8/1996 Palange ..... D04B 3/02 66/1 R
6,065,968 A * 5/2000 Corliss ..... G09B 23/04 273/157 R
D469,818 S * 2/2003 Asou ..... D21/398
6,834,682 B2 * 12/2004 Jenner ..... D03D 29/00 139/29
7,506,524 B2 * 3/2009 Gustin ..... D04B 5/00 66/1 A
7,677,273 B2 * 3/2010 Skaflestad ..... D03D 29/00 139/1 R
7,946,631 B2 * 5/2011 Crorey ..... D04G 5/00 289/2
8,316,894 B2 * 11/2012 Schaub ..... D03D 29/00 139/1 R
D676,879 S * 2/2013 Hudgins ..... D15/66
8,402,794 B2 * 3/2013 Sasur ..... D04B 5/00 66/3
8,485,565 B2 * 7/2013 Ng ..... A44C 5/0069 289/17
8,622,441 B1 * 1/2014 Ng ..... D04D 1/00 289/17
8,684,420 B2 * 4/2014 Ng ..... A44C 5/0069 289/17
D711,931 S * 8/2014 Daftari ..... D15/66
D717,347 S * 11/2014 Hatcher ..... D15/66
D721,744 S * 1/2015 Daftari ..... D15/66
9,038,673 B2 * 5/2015 Roy et al. ..... D03D 29/00 139/29
D732,582 S * 6/2015 Verona ..... D15/66
D737,044 S * 8/2015 Hayakawa ..... D3/18
D754,216 S * 4/2016 Ng ..... D15/66
2008/0223083 A1 * 9/2008 Gustin ..... D04B 5/00 66/1 A
2013/0038008 A1 * 2/2013 Hall ..... D04D 1/04 269/1

OTHER PUBLICATIONS

Purl & Loop LLC—"Mini Weaving Loom Kit" archive screenshots of applicant's website, www.purlandloop.com dated Oct. 15, 2014 showing additional details of the product shown in the Nov. 26, 2013 archive screenshots. 2 pages.
Purl & Loop LLC—"Weaving Looms—Mini Weaving Loom Kit" archive screenshots of applicant's website, www.purlandloop.com dated Oct. 15, 2014 showing additional details of the product shown in the Nov. 26, 2013 archive screenshots. 2 Pages.
Purl & Loop LLC—Screenshots from Purl & Loop LLC's tutorial video entitled: "Ribbon Mini Weaving Loom Tutorial". Uploaded to Applicant's YouTube Channel on Jun. 10, 2014. 11 pages.
Purl & Loop LLC—"Weaving Looms—Stash Blaster Mini (Coaster Size and Placemat Size) Weaving Loom" archive screenshots of applicant's website, www.purlandloop.com dated Feb. 25, 2015. 2 Pages.
Purl & Loop LLC —"Weaving Looms—Stash Blaster Mini (Coaster Size) Weaving Loom" archive screenshots of applicant's website, www.purlandloop.com dated Feb. 27, 2015. 2 Pages.
Purl & Loop LLC—"Weaving Looms—Stash Blaster Mini (Coaster Size) Weaving Loom" photos, www.purlandloop.com dated Feb. 27, 2015. 5 Pages.
Purl & Loop LLC—"Weaving Looms—Stash Blaster Placemat Weaving Loom" archive screenshots of applicant's website, www.purlandloop.com dated Feb. 27, 2015. 2 Pages.
Purl & Loop LLC—"Weaving Looms—Stash Blaster Placemant Weaving Loom" photos, www.purlandloop.com dated Feb. 27, 2015. 6 Pages.
Schacht Spindle Company, Inc.—"Mini Loom—All you need to do is weave". Manual available online at schachtspindle.com/pdfs/mini-loom-book.pdf. 2011. 8 Pages.
Schacht Spindle Company, Inc.—"The Mini Loom Weaving Kit"—webpage excerpt printed Feb. 15, 2015. 2 Pages.

* cited by examiner

MULTIPURPOSE PORTABLE MINI LOOM

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Field of the Invention

The present invention relates to weaving looms, more particularly to a handheld, portable mini loom for making swatches, and even more particularly to a handheld portable mini loom capable of making swatches using yarn threads warped in varying Ends Per Inch ("EPI").

Portable mini looms known in the art are employed for assisting users in weaving small-sized swatches that are used as household decorative items, garment patches, etc. These mini looms can also be used as testing implements for producing quick test swatches before proceeding to set up large-sized table and floor looms. Although, the prior art mini looms come in different sizes and materials, a major drawback with them is that no single mini loom is designed to support yarn threads that can be warped in different EPIs.

There exists a need in for a portable mini loom that allows for more flexibility and creativity by providing different EPI configurations in a single mini loom.

BRIEF SUMMARY OF INVENTION

The present invention comprises a portable, handheld mini loom for weaving swatches. The mini loom is designed to permit weaving of swatches made from yarn/thread to be warped at different EPIs. The mini loom can also be used as a testing implement for producing quick test swatches before proceeding to set up large-sized table and floor looms.

In a preferred embodiment, there is disclosed a portable, handheld mini loom having an upper side (working) surface and an under side surface. The loom comprises a base section having upper side and under side surfaces. The base has a desired thickness, width and length. The width of the base is defined by opposed side edges. The length of the base is defined by opposed first and second ends. Each of the first and second ends comprises an EPI zone comprising a plurality of EPI arrays to permit warping yarn/thread across the width of the loom at a selected one of the plurality of predefined EPI arrays. Each of the first and second ends may also further comprise a riser section extending the EPI zone upward from the face of the working surface of the base to create a weaving clearance height to facilitate the weaver's act of weaving the weft threaded needle over and under alternating warp threads.

In one embodiment, the EPI zone comprises three separate EPI arrays, of differing EPI, capable of permitting the weaver to select one of such EPI arrays to create a warp of a predefined EPI, such as, 8, 10 or 12 EPI. In one embodiment, the 8 EPI array comprises a series of notches along the outer (distal) edges of the first and second ends of the base, and aligned with each other. In this embodiment, the 10 and 12 EPI arrays comprise a series of spaced apart holes extending through the base and extending in spaced fashion across the width of the base proximate the first EPI array. Each of the 10 and 12 EPI arrays are preferably configured to arrange their respective through holes in a zig zag pattern created with holes along two parallel lines where each hole, from left to right (between the first and second line of holes) provides the calculated EPI when warped with thread/yarn.

In another embodiment, there is disclosed a portable mini loom comprising: (a) a base section having an upper working side surface and an underside surface defining a desired thickness therebetween, opposed first and second end edges defining a desired overall length ($L_1$), and opposed first and second side edges defining a desired overall width ($W_1$); (b) a first Ends Per Inch (EPI) zone disposed proximate the base first end edge and extending inwardly along a desired length ($L_3$) of the overall length ($L_1$), the first EPI zone having an outer first EPI zone edge shared with the base first end edge, an inner first EPI zone boundary opposite the outer first EPI zone edge, an upper first EPI zone working surface on the base working surface, and a first EPI zone underside surface on the base underside surface, and (c) a second EPI zone disposed proximate the base second end edge and extending inwardly along a desired length ($L_3$) of the overall length ($L_1$), the second EPI zone having an outer second EPI zone edge shared with the base second end edge, an inner second EPI zone boundary opposite the outer second EPI zone edge, an upper second EPI zone working surface on the base working surface, and a second EPI zone underside surface on the base underside surface.

In this embodiment, the first EPI zone further comprises (i) a first distal array of slots disposed along the base first end edge, the slots extending along a desired working width ($W_2$) of the overall width ($W_1$), the slots capable of receiving a warp thread therethrough and being uniformly spaced apart from each other to form spacing for a first desired warp thread EPI; (ii) a first mid array of through holes disposed across the first EPI zone, the first mid array of through holes extending along the desired working width ($W_2$) of the overall width ($W_1$), the first mid array of through holes capable of receiving a warp thread therethrough and being uniformly spaced apart from each other to form spacing for a second desired warp thread EPI; and (iii) a first proximal array of through holes disposed across the first EPI zone, the first proximal array of through holes extending along the desired working width ($W_2$) of the overall width ($W_1$), the first proximal array of through holes capable of receiving a warp thread therethrough and being uniformly spaced apart from each other to form spacing for a third desired warp thread EPI.

Similarly, the second EPI zone further comprises (i) a second distal array of slots disposed along the base second end edge, the slots extending along the desired working width ($W_2$) of the overall width ($W_1$), the slots capable of receiving a warp thread therethrough and being uniformly spaced apart from each other to form spacing for the first desired warp thread EPI; (ii) a second mid array of through holes disposed across the second EPI zone, the second mid array of through holes extending along the desired working width ($W_2$) of the overall width ($W_1$), the second mid array of through holes capable of receiving a warp thread therethrough and being uniformly spaced apart from each other to form spacing for the second desired warp thread EPI; and (iii) a second proximal array of through holes disposed across the second EPI zone, the second proximal array of through holes extending along the desired working width ($W_2$) of the overall width ($W_1$), the second proximal array of through holes capable of receiving a warp thread therethrough and being uniformly spaced apart from each other to form spacing for the third desired warp thread EPI.

In this embodiment, each of the first distal array of slots disposed along the base first end edge is aligned with a respectively opposed one of the second distal array of slots disposed along the base second end edge; each of the first mid array of through holes disposed across the first EPI zone is aligned with a respectively opposed one of the second mid array of through holes disposed across the second EPI zone; and each of the first proximal array of through holes disposed across the first EPI zone is aligned with a respectively opposed one of the second proximal array of through holes disposed across the second EPI zone.

A weaving zone area is provided as defined by the working width ($W_2$) along a weaving zone length ($L_2$) extending from the inner first EPI zone boundary to the inner second EPI zone boundary.

In one embodiment, the mini loom is capable of receiving the warp thread to create a warp of the desired first, second or third warp thread EPI, by looping the warp thread, between corresponding slots in the upper working surfaces of the opposed first and second distal arrays, by looping the warp thread between corresponding through holes in the upper working surfaces of the opposed first and second mid arrays, or by looping the warp thread between corresponding through holes in the upper working surfaces of opposed first and second proximal arrays, respectively.

In another embodiment, the first and second EPI zones extend upwardly from the upper working surface of the base to a desired warp clearance height ($H_2$), the first and second EPI zone inner boundaries forming first and second EPI zone inner edges, the distance between the first and second EPI zone inner edges defining a weaving area length ($L_2$).

In one embodiment, the first desired warp thread EPI is 8 EPI, the second desired warp thread EPI is 10 EPI, and the third desired warp thread EPI is 12 EPI.

Other objects and advantages of the embodiments herein will become readily apparent from the following detailed description taken in conjunction with the accompanying drawings.

DETAILED DESCRIPTION OF THE INVENTION

Figure 1:
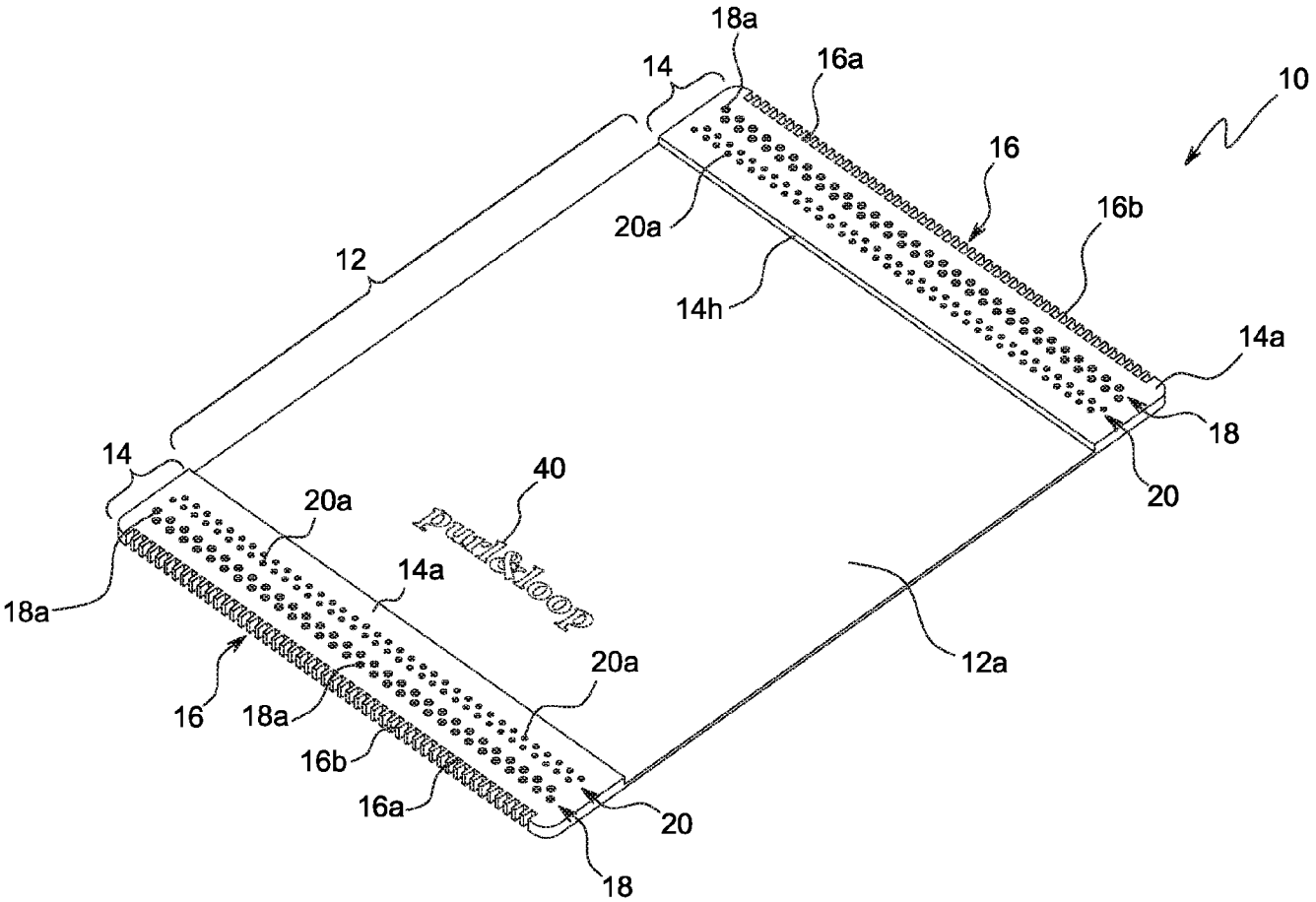
FIG. 1, according to an embodiment of the present invention, is an illustration of a top perspective view of the mini loom.
Figure 2:
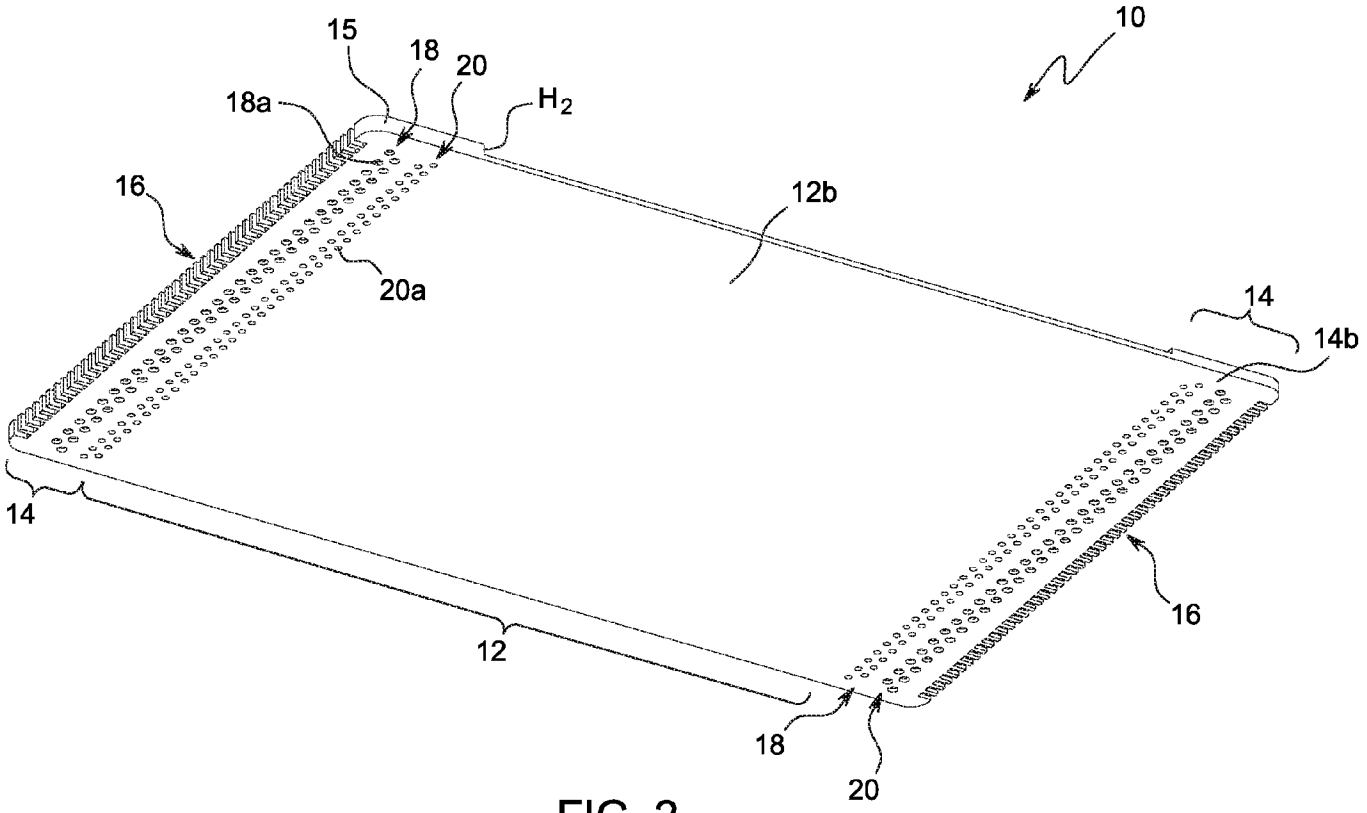
FIG. 2, according to an embodiment of the present invention, is an illustration of a bottom perspective view of the mini loom of FIG. 1.
Figure 4:
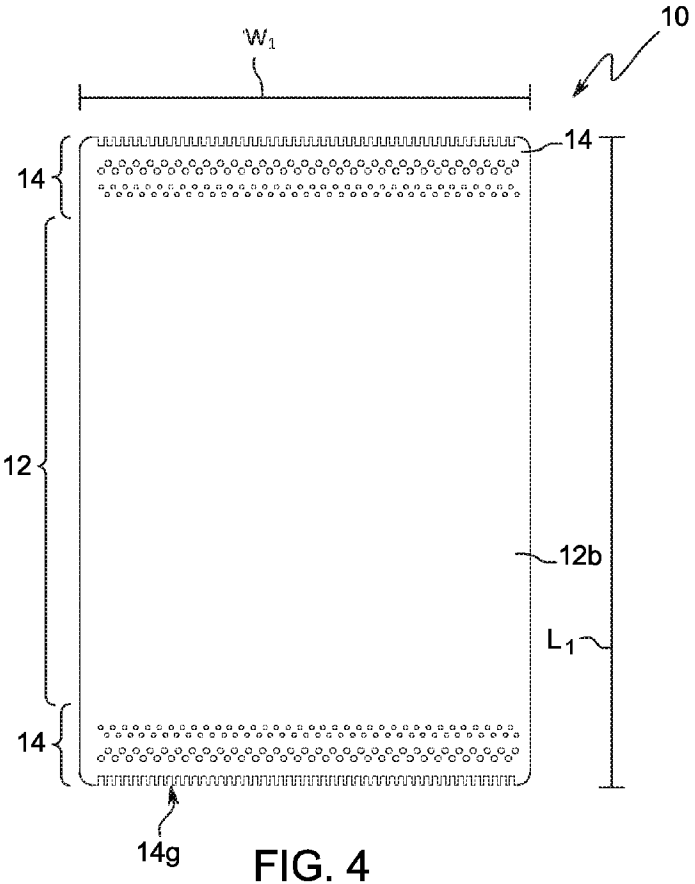
FIG. 4, according to an embodiment of the present invention, is an illustration of a bottom planar view of the mini loom of FIG. 1.
Figure 3:
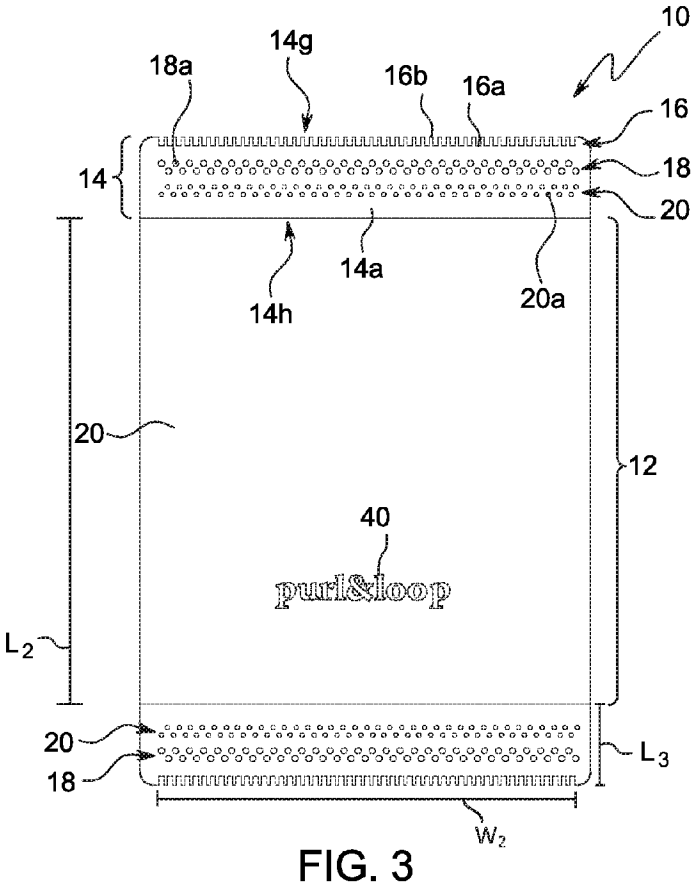
FIG. 3, according to an embodiment of the present invention, is an illustration of a top planar view of the mini loom of FIG. 1.
Figure 5A:
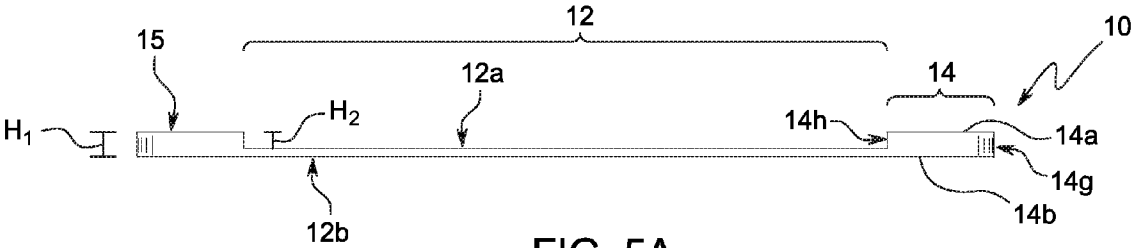
FIG. 5A, according to an embodiment of the present invention, is an illustration of a side plan view of the mini loom of FIG. 1.
Figure 5B:
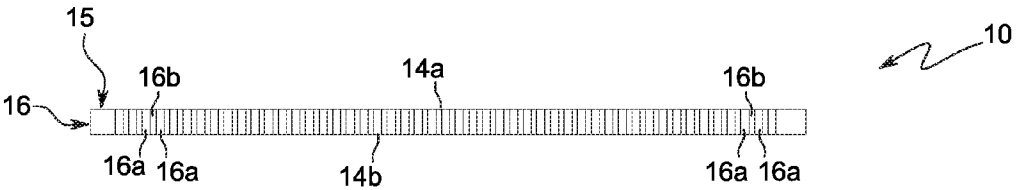
FIG. 5B, according to an embodiment of the present invention, is an illustration of an end plan view of the mini loom of FIG. 1.

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The present invention comprises a portable, handheld mini loom 10 of overall length ($L_1$) and overall width ($W_1$) defining a weaving area of working width ($W_2$) by weaving section length ($L_2$) for weaving swatches 52 of desired sizes and materials within such working space. The mini loom 10 is designed to permit weaving of swatches made from yarn to be warped at a selection of different EPIs. The mini loom can also be used as a testing implement for producing quick test swatches before proceeding to set up large-sized table and floor looms. Terms of interest used herein include: "EPI" (Ends Per Inch)—the number of warp yarns in one inch of warp; "Pick"—One weft; "PPI" (Picks Per Inch)—the number of weft yarns in one inch of weaving; "Sett"—The spacing of the yarn on the loom; "Warp"—The yarn held taut on the loom; "Weft"—The yarn that the weaver weaves over and under the warp threads; and "Warping"—The act of setting up the loom.

The mini loom 10 comprises a base 11 of overall length ($L_1$) further comprising a mid section 12 of length ($L_2$) and a pair of opposingly-disposed extremity sections or EPI zones 14 of length ($L_3$) extending along each of the opposing end edges of the mid section 12. The mid section 12 comprises a rectangular member with planar front and rear surfaces, 12*a*, 12*b*, respectively. Each extremity section 14 comprises a rectangular member as well with front planar surface 14*a*, rear planar surfaces 14*b*, outer edge 14*g* and inner edge 14*h*. The thicknesses or heights ($H_1$) of the extremity sections or EPI zones 14 are preferably greater than that of mid section 12 to create a space beneath the warp of height ($H_2$) to facilitate passage of the weaving needle 26 (with weft thread 32) through the warp 22. As such, the front surfaces 14*a* of the extremity sections are preferably elevated or stepped up with respect to the front surface 12*a* of the mid section 12. As will be apparent, the weaving area of this mini loom 10 is defined as the space above the mid section upper (working) surface 12*a*, and between the opposed EPI zones (between opposed inner edges 14*h* along length ($L_2$).

Each extremity section or EPI zone 14 further comprises a plurality of longitudinally disposed, thread-receiving arrays (also referred to as "EPI arrays") 16, 18, 20. In one embodiment, each EPI zone contains three longitudinally disposed, thread-receiving arrays 16, 18, 20 that are parallel to and spaced apart from one another across a desired working width ($W_2$) of the overall width ($W_1$) of the mini loom 10 and the length ($L_3$) of the EPI zone 14. In this embodiment, the three arrays comprise a distal array 16, a mid array 18, and a proximal array 20 wherein the mid array 18 is disposed between the proximal and distal arrays, 16, 20. Each EPI array comprises a multiplicity or plurality of thread-receiving members for enabling a warp yarn thread 22 to be looped therethrough during the warping of the loom 10. More particularly, with respect to the distal array 16, the thread-receiving members comprise an array of notches, slots, or other indentations 16*a* (or spaced apart distal array prongs 16*b*) disposed in spaced relation along the outer edge of the extremity section or EPI zone 14. In this embodiment, the distal array 16 is dimensionally configured across the working width ($W_2$) to support a predetermined warp thread count, here, for example, 8 EPI. The thread-receiving members for the mid and proximal arrays 18, 20 comprise a multiplicity or plurality of spaced apart through holes 18*a*, 20*a*. In the embodiments disclosed, the holes 18*a*, 20*a* pertaining to the mid and the proximal arrays 18, 20 are arranged in respective zigzag patterns across the working width ($W_2$) to define the requisite number of through holes per inch, which in turn defines the respective EPI for such mid and proximal arrays. In this embodiment, the mid and proximal arrays 18, 20 are dimensionally configured across the working width ($W_2$) to receive predetermined warp thread counts of, for example, 10 and 12 EPI therethrough respectively.

The present disclosure provides a mini loop tool 10 for weavers to test swatches 52 before investing time in setting up their large table and floor looms. The typical EPIs rigid heddle weavers work with are 8, 10 and 12 EPI. The device of the present disclosure is designed to provide multiple potential EPI configurations in an EPI zone 14. In this embodiment, weavers can warp the prong section or distal EPI array 16 at 8 EPI (using indentations 16*a*), or thread the middle row/array (mid EPI array 18) of through holes 18*a* at 10 EPI, or thread the bottom (proximal) row/array (proximal EPI array 20) of holes 20*a* at 12 EPI. Other EPI configurations could be arranged together in similar fashion, but the currently disclosed arrangement of 8, 10 and 12 EPI in the EPI zone 14 provides a very convenient selection for testing various swatches 52 on a portable mini loom 10.

Figure 10:
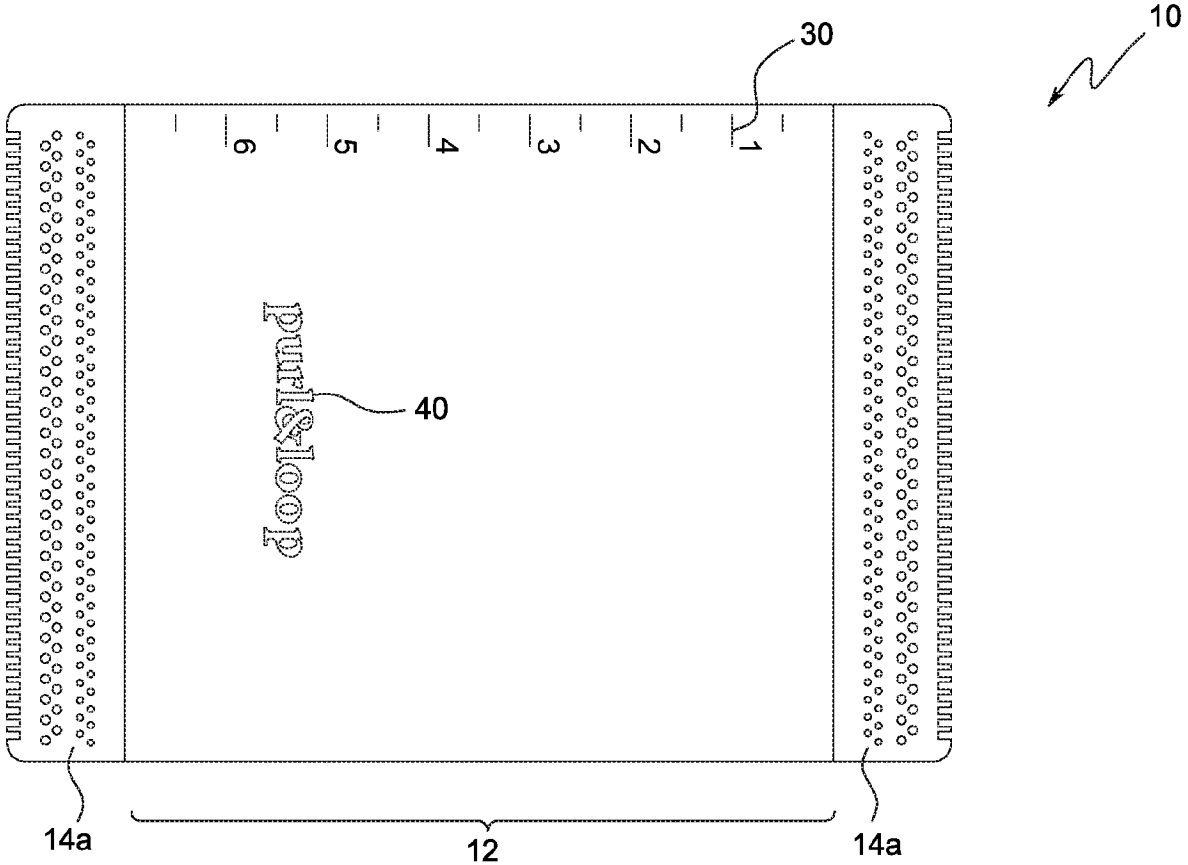
FIG. 10, according to an embodiment of the present invention, is an illustration of a top plan view of the mini loom of FIG. 3 further configured with ruled markings along a side edge between the extremity or EPI zone sections.

In one embodiment, a ruler or scale 30 (e.g., as shown in FIG. 10) is provided on the side edge to permit the weaver to measure the progress of the weaving. The scale or ruled markings 30 can be painted on or laser etched onto the working surface 12*a* of the mini loom 10. The loom 10 is portable (can fit in most purses or small carrying cases) and provides weavers the ability to test multiple (here 3) different gauges all in one product.

The mini loom device 10 preferably consists of a body section having an underside face 12*b*, and an upper side face 12*a*, a desired overall width ($W_1$) defined by opposed side edges, and a desired length ($L_1$) defined by opposed first and second body ends (11*a*, 11*b*). The loom further comprises a prong section (distal array) 16 along a desired portion of the width of the outermost edges of the first and second opposed ends of the body section. The prongs 16*b*, (creating notches or indentations 16*a* therebetween), are evenly spaced apart as a first (distal) array to create an exemplary 8 EPI (or other desired EPI) across the working width ($W_2$) of each of the respective outer edges of the body first and second ends (11*a*, 11*b*). Each of the prongs 16*b* and notches 16*a* along the first edge of the body are directly aligned with each of the respectively corresponding prongs and notches on the opposed second edge of the body to permit the weaver to wind the warp thread/yarn 22, in taut fashion, around the length of the loom (between each of the respectively aligned notches in the upper and lower edges) and across the desired working width of the loom to create the desired width of the warp thread at the warp EPI defined by the spacing of the prongs and notches (here, when using each adjacent notch 16*a*, the spacing is designed to be a desired, predetermined EPI, e.g., 8 EPI). This process is referred to as the act of "warping". The alignment of the notches 16*a* on each end also permits the weaver to create a warp that can be perpendicular to the weft.

In one embodiment, the notches 16*a* comprise square cut notches (as shown). In another embodiment, the notches comprise "V" shaped notches (not shown). In yet another embodiment, the notches comprise rounded indentations (not shown). In yet another embodiment, the notches comprise a mixture of square cut, V cut or rounded indentations (not shown), such mixture being used to visually assist the weaver in properly aligning the warp thread from the top edge to the bottom edge of the mini loom.

A second (or mid) array 18 of through holes 18*a* defining a different EPI across the working width ($W_2$) of the body 10 are also located within the EPI zone 14 proximate the first and second ends of the body section. Depending on the EPI relative to the width of the base 11, it may be desired for this second array 18 to comprise two parallel lines of through holes 18*a* offset from each other, in zig-zag fashion. For example, in a preferred embodiment, this second array is designed to provide 10 EPI. As such, each of the two parallel lines will be designed to provide 5 EPI. The first of the 5 EPI lines will be located on the base 11 proximate the end, and the second of the 5 EPI lines will be located closely beneath the first 5 EPI line, but will have its respective through holes aligned, not directly beneath the through holes of the first 5 EPI line, but instead, offset so that holes on the second 5 EPI line will be directly beneath the spaces between holes on the first 5 EPI line so that the net effect, is that the left to right progression of the holes 18*a* alternating between the first and second 5 EPI lines create an array that is equivalent to 10 EPI (or other desired EPI).

Similarly, a third (or proximal) array 20 of through holes 20*a* defining a different EPI across the working width ($W_2$) of the body 10 are also located within the EPI zone 14 proximate the first and second ends of the body section. Depending on the EPI relative to the width of the base 11, it may be desired for this second array to comprise two parallel lines of through holes 20*a* offset from each other, in zig-zag fashion. For example, in a preferred embodiment, this third array is designed to provide 12 EPI. As such, each of the two parallel lines will be designed to provide 6 EPI. The first of the 6 EPI lines will be located on the base 11 proximate the end, and the second of the 6 EPI lines will be located closely beneath the first 6 EPI line, but will have its respective through holes aligned, not directly beneath the through holes of the first 6 EPI line, but instead, offset so that holes on the second 6 EPI line will be directly beneath the spaces between holes on the first 6 EPI line so that the net effect, is that the left to right progression of the holes 20*a* alternating between the first and second 6 EPI lines create an array that is equivalent to 12 EPI (or other desired EPI).

The area along the first and second ends of the base 11, containing the first, second and third EPI arrays (16, 18, 20) may be referred to as EPI zones 14, the base 11 comprising an EPI zone 14 at each of its first and second ends (11*a*, 11*b*) for defining the warp of a proposed swatch.

The planar body section 11 as set out above could be used, by itself, as a mini loom. However, in a preferred embodiment, each of the first and second ends (11*a*, 11*b*) of the body (the EPI zones 14) further comprise a raised section 15 along the width of the ends of the body. These raised sections 15 provide spacing ($H_2$) between the upper face 12*a* of the loom base 11, and the actual threaded warp 22 to later facilitate weaving the weft threads 32 over and under the adjacent warp threads 22, and to facilitate use of the tapestry needle 24. As set out above, these riser sections of height ($H_1$) would be configured to contain the EPI zone, namely, the riser would contain the first, second and third (or additional) EPI arrays.

In one embodiment, the base 11 comprises a planar, substantially rectangular work piece of a desired thickness and material. In a preferred embodiment, the material is wood, including solid wood and laminates. In another embodiment, the material is a rigid plastic, such as acrylic or other suitable plastic and can be clear, translucent, opaque or nontransparent in coloration, and can be finished in a smooth, matte or glossy finish (or combination of such finishes). However, this mini loom can be constructed of any suitable material capable of receiving the EPI arrays, and maintaining the rigidity required for the taut warp threads, including, metal, and composite materials. The notches 16*a* (first EPI array 16), and the through holes 18*a*, 20*a* (second, third, fourth, etc. EPI arrays 18, 20) can be fashioned using standard techniques such as drilling, cutting, and the use of laser cutting. In one embodiment, the thickness of the base 11 is ⅛ inches and each of the risers 15 extends at least ⅛ inches above the upper face of the base 11. In a preferred embodiment, the base 11 is ⅛ inches thick and each of the riser sections extend above the upper face of the base 11 by about ¼ inches to provide about ¼ inch clearance ($H_2$) between the base upper face 12*a* and the underside of the warp thread 22 ("weaving clearance height", $H_2$) once warping is completed. The weaving clearance height ($H_2$) facilitates, e.g., the weaver's act of weaving the weft 32 threaded or tapestry needle 26 (e.g., a metal tapestry needle) over and under alternating warp threads 22.

In one embodiment, the base 11 and the risers 15 (14*e*, 14*d*) are fabricated from the same starting material. For example, where the starting material is wood or plastic, the base layer 11 (for example ⅛ inch in thickness) can first have the various EPI arrays 16, 18, 20 laser cut into each opposed first and second ends (EPI zones 14) of the base 11. A laser cutting tool can be used to create the precision notches 16*a* of the first EPI array 16 as well as the desired arrays (18, 20) of through holes (18*a*, 20*a*) comprising the first and second EPI arrays. If desired, the corners of the base 11 can be cut in a rounded fashion as shown. Separate riser sections 14*e*, 14*d* could be cut and constructed out of the same starting material. Then the desired riser height ($H_1$) could be achieved by gluing riser sections 14*e*, 14*d* in stacked fashion to each end of the base 11. For example, where the base is ⅛ inch in thickness, two separately cut riser sections 14*e*, 14*d* (each ⅛ inch in thickness) could be glued or otherwise fixably attached to each end of the base in stacked fashion to provide an approximately ¼ inch weaving clearance height ($H_2$).

In another embodiment, the base section 11 and riser sections 14*e*, 14*d* could be separately fashioned and then the riser sections could be attached to the base 11. For example, where the base section 11 is ⅛ inches in thickness a riser section 15 could be constructed that was constructed from one piece of material that was ¼ inch thick (or other desired thickness). As one of ordinary skill in the art will realize having the benefit of the present disclosure, the actual mini loom can be constructed using many different materials and fabrication techniques to achieve the design of this mini loom 10.

In one embodiment, the weaver can use the mini loom 10, and vary the EPI by skipping one or more of the notches 16*a*, or through holes 18*a*, 20*a*, in the respective array, during the warping process. For example, the weaver could use just the outmost rows of the mid array 18 in each EPI zone 14 to achieve a warp of 5 EPI. However, one of the benefits of the preferred embodiment of the mini loom 10 is that it has an EPI zone 14 that comprises three predefined, preferred EPI arrays comprising 8, 10 and 12 EPI.

In another embodiment, the mini loom can bear a proprietary logo 40 or other promotional information displayed on an attached a sticker, painted on, or laser etched into the surface(s) 12*a*, 12*b* of the loom 10.

In one embodiment, the overall length ($L_1$) is approximately 9.25 inches and the overall width ($W_1$) is approximately 6.5 inches. In this embodiment, the working space for creating a swatch (i.e., the space defined by the working width ($W_2$) and the length of the weaving section ($L_2$)) is approximately 6 inches ($W_2$) by 7 inches ($L_2$). In this embodiment, where the slots define 8 EPI, the weaver would need about 40 yards of thread, e.g., 30 yards of warp and 10 yards of weft. In this embodiment, where the holes define 10 EPI, the weaver would need about 47 yards of thread, e.g., 35 yards of warp and 12 yards of weft. In this embodiment, where the holes define 12 EPI, the weaver would need about 55 yards of thread, e.g., 40 yards of warp and 15 yards of weft.

It will be understood by those having the benefit of the present disclosure that the mini-loom can be constructed of any desired size (but preferably one that remains a hand held portable size) and can have multiple desired EPI capabilities in the EPI zone. In the preferred embodiment described herein, the mini loom measures about 60 $in^2$.

Referring to FIGS. 1 through 5, the mini loom 10 is comprises a base 11 having a mid section 12 and a pair of opposingly-disposed extremity sections 14 extending from opposing edges of the mid section 12 such that, in one embodiment, the extremity sections 14 are mirror reflections of each other. The mid section 12 comprises a rectangular member with planar front 12*a* and rear 12*b* surfaces. In this embodiment, the extremity section or EPI zone 14 comprises a rectangular riser member 15 as well with front 14*a* and rear 14*b* planar surfaces. As can be appreciated from FIG. 5, the thicknesses of the extremity sections 14 are greater than that of mid section 12. The rear surfaces of the extremity sections 14 are flush with that of the mid section 12 and as a result, the front surfaces of the extremity sections 14 are elevated or stepped up by height ($H_2$) with respect to the front surface 12*a* of the mid section 12. The mid section 12 may further comprise a scale 30 imprinted on the front surface 12*a* thereof for the measurement of weaving progress. The scale 30 extends between the pair of extremity sections 14. As can be appreciated from the referred drawings, the free corners of the extremity sections 14 may be rounded off. The mini loom 10 is made of materials that are preferably readily cut with a laser cutter. In one embodiment, the mini loom 10 is made of wood such as, birch wood, or a synthetic material such as, acrylic. However, notably, the mini loom 10 being made of other suitable material is well within the scope of the present invention.

Figure 6:
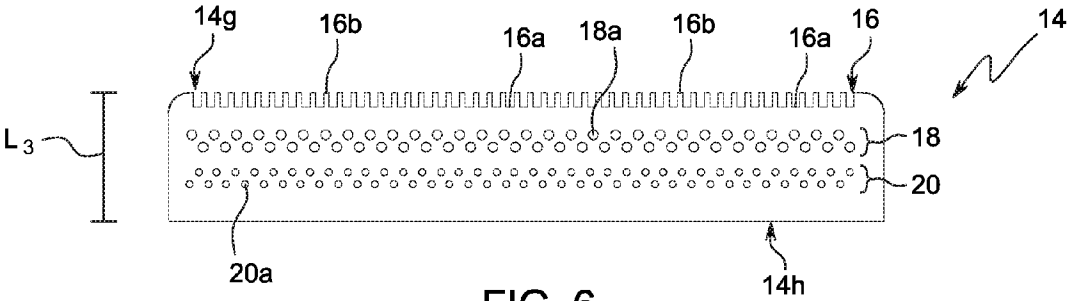
FIG. 6, according to an embodiment of the present invention, is an illustration of a plan view of an extremity member, EPI zone, or warp selection section.
Figure 8A:
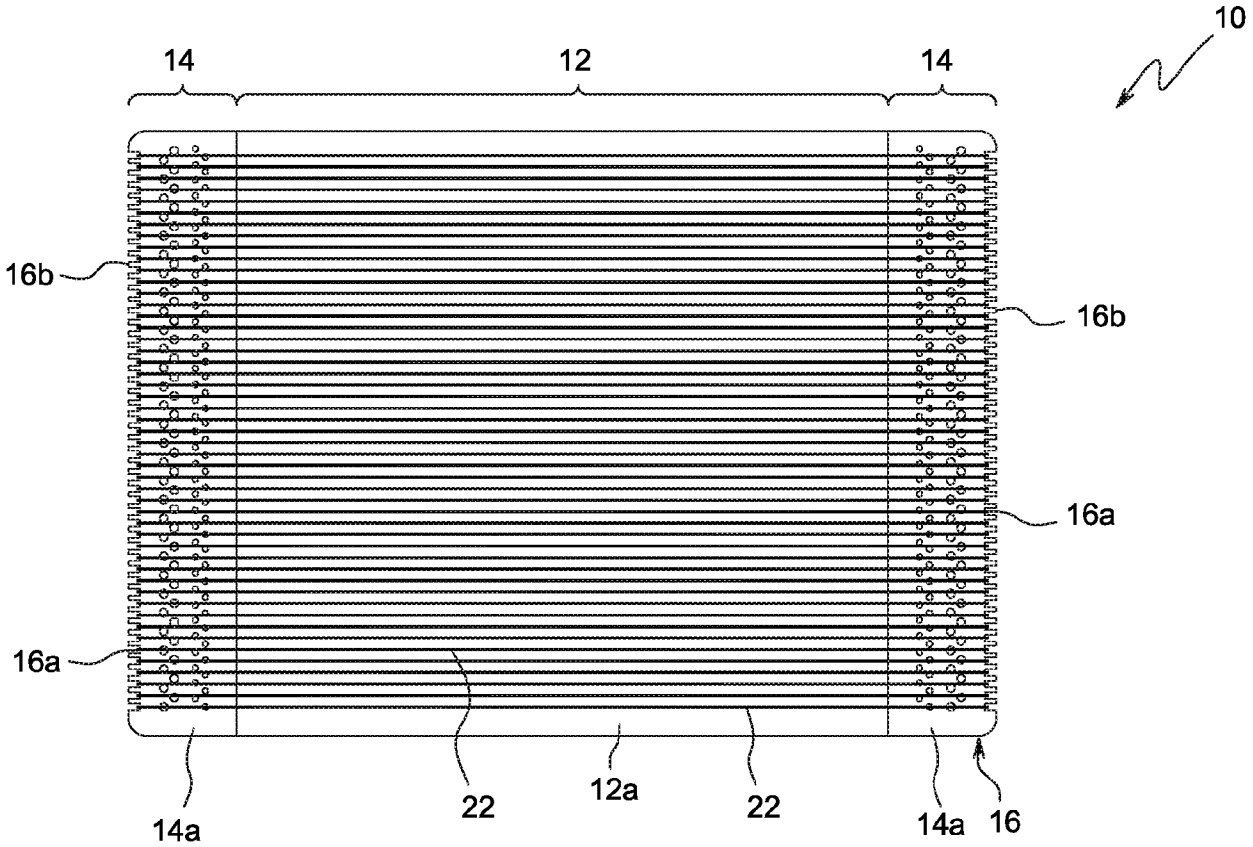
FIG. 8A, according to an embodiment of the present invention, is an illustration of a top plan view of the mini loom of FIG. 1 being received with a yarn thread in the outer pronged portion of the warp selection section, here, e.g., a row of end slots creating a warp of 8 EPI.
Figure 8B:
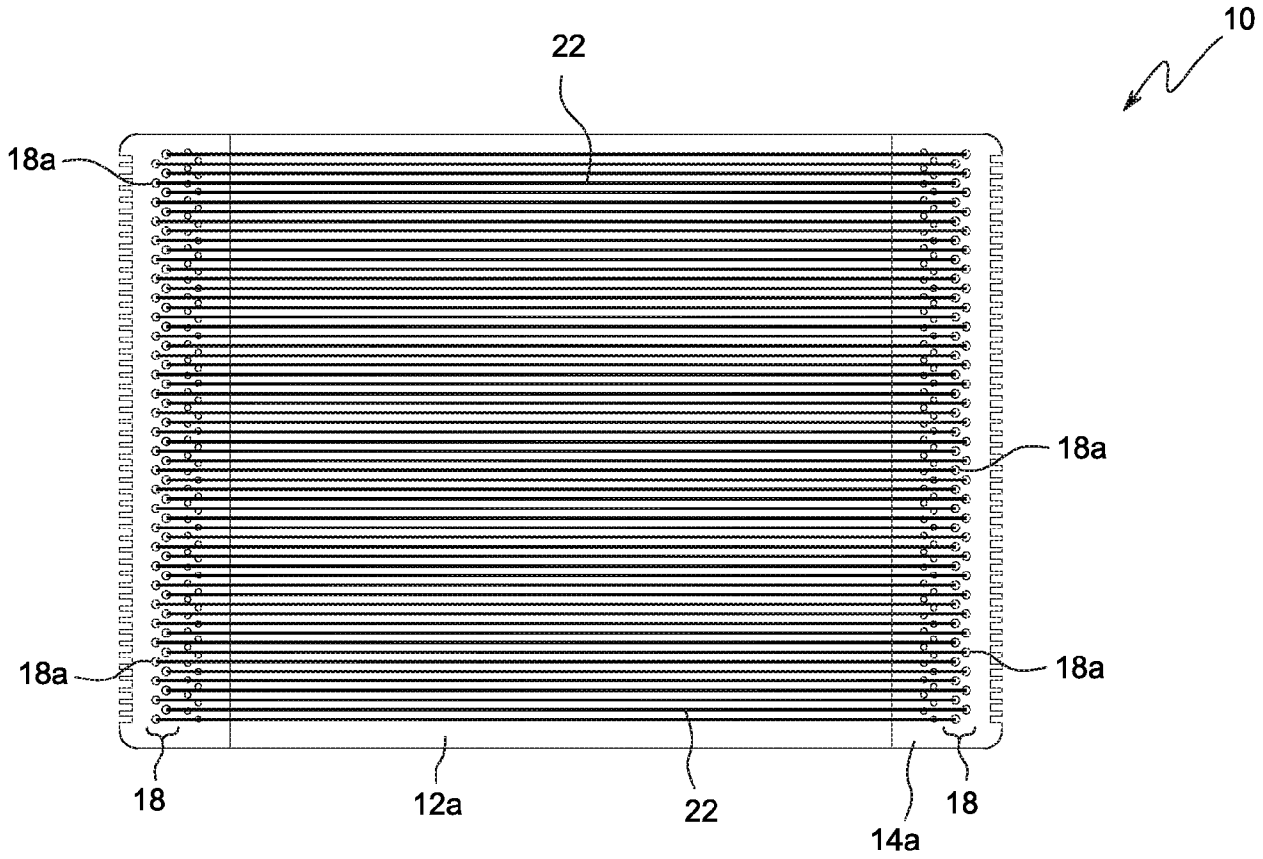
FIG. 8B, according to an embodiment of the present invention, is an illustration of a top plan view of the mini loom of FIG. 1 being received with a yarn thread in the middle portion of the warp selection section, here, e.g., an array of holes creating a warp of 10 EPI.
Figure 8C:
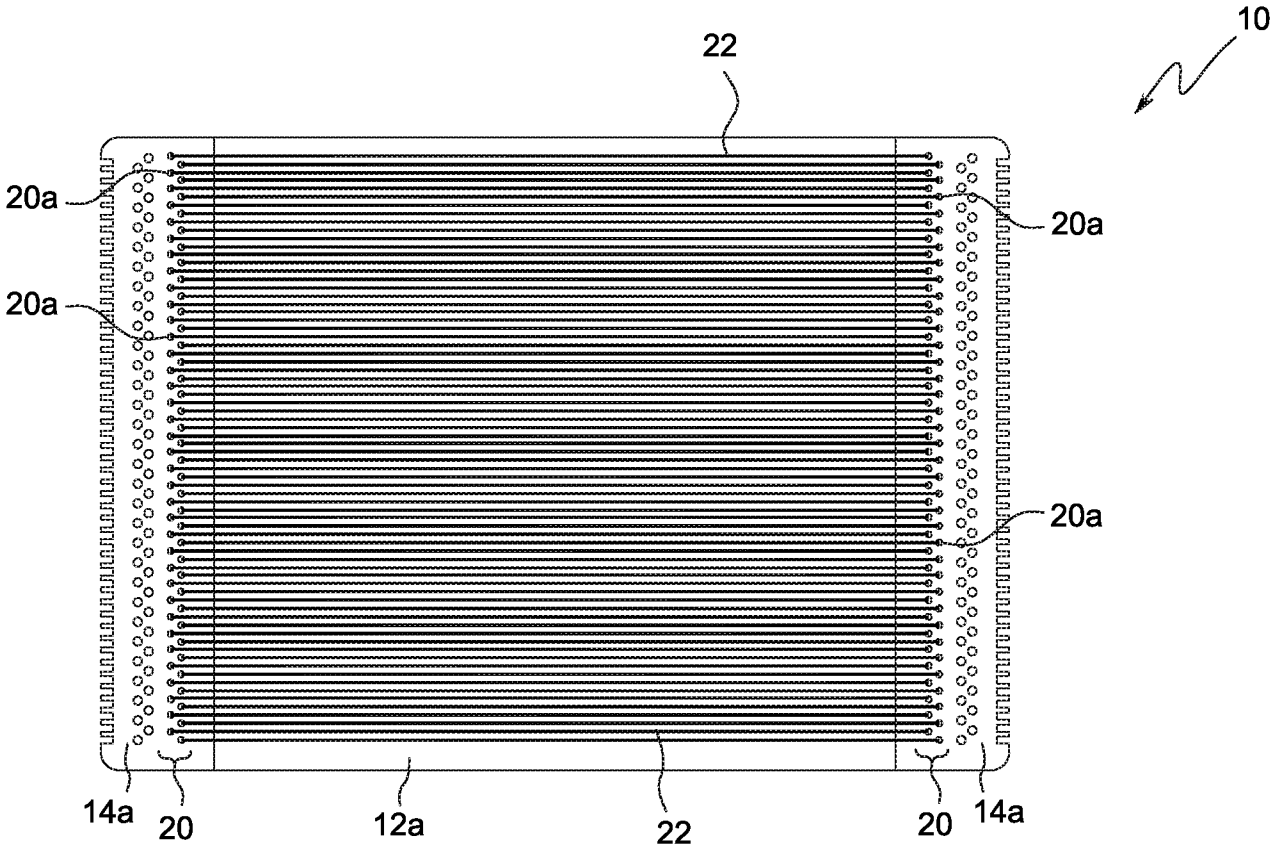
FIG. 8C, according to an embodiment of the present invention, is an illustration of a top plan view of the mini loom of FIG. 1 being received with a yarn thread in the inside portion of the warp selection section, here, e.g., an array of holes creating a warp of 12 EPI.

Referring to FIG. 6, the extremity section 14 further comprises three longitudinally disposed, thread-receiving arrays 16, 18, 20 that are parallel to and spaced apart from one another. The three arrays comprise a distal array 16, a mid array 18, and a proximal array 20 wherein, the mid array 18, as the term suggests, is disposed between the proximal and distal arrays 16 and 20. Each array comprises a multiplicity of thread-receiving mechanisms for enabling a warp yarn thread 22 to be looped therethrough. More particularly, in case of the distal array 16, the thread-receiving mechanisms comprise rectangular cuts or slots 16*a* made into the free outer edge of the extremity section 14. Therefore, as can be appreciated from FIG. 6, the distal array 16 is disposed along the free outer edge of the extremity section 14. In a preferred embodiment, the distal array 16 is dimensionally configured to support a warp yarn/thread 22 bearing a warp of 8 EPI (exemplarily shown in FIG. 8A). The mid and proximal arrays 18 and 20 comprise a multiplicity of thorough holes 18*a*, 20*a* (extending between the front and rear surfaces 14*a*, 14*b* of the extremity member 14) for the multiplicity of thread-receiving mechanisms. Notably, as can be appreciated from FIG. 6, the holes 18*a*, 20*a* pertaining to the mid and the proximal arrays 18 and 20 are arranged in a zigzag fashion. In this preferred embodiment, the mid and proximal arrays 18 and 20 are dimensionally configured to receive thread 22 with warps of 10 and 12 EPIs therethrough respectively (as exemplarily shown in FIGS. 8B and 8C respectively). Notably, the number of arrays is not limited to three and neither is the thread EPIs supported by the arrays. The mini loom 10 may support arrays more or less than three, and each of those arrays may support threads of various EPIs and still be within the scope of the invention.

Figure 7A:
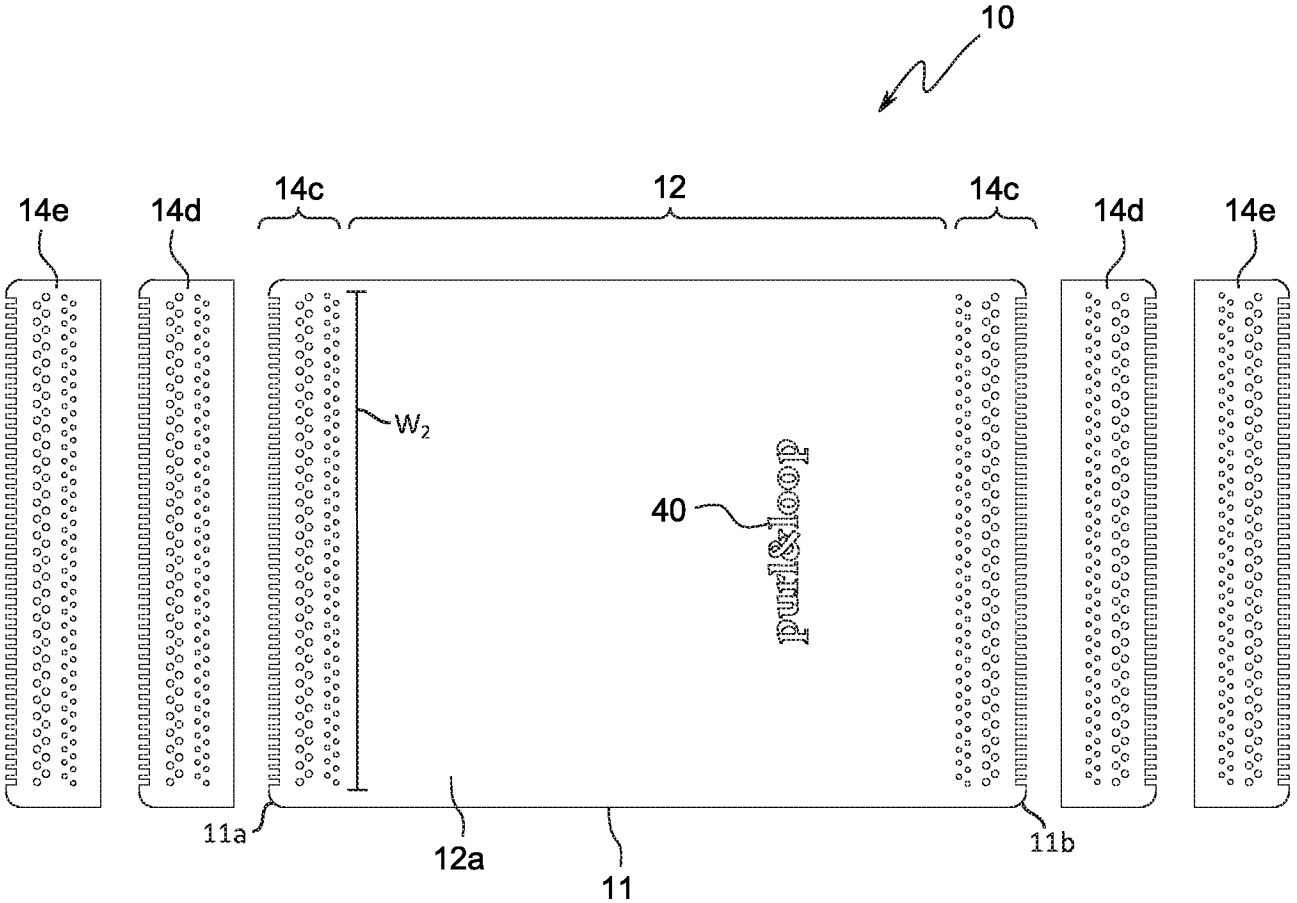
FIG. 7A, according to an embodiment of the present invention, is an illustration of a plan view of a disassembled mini loom of FIG. 1 illustrating the base layer and the extremity member layers where the height of the warp selection section is fashioned from multiple layers added to the base.
Figure 7B:
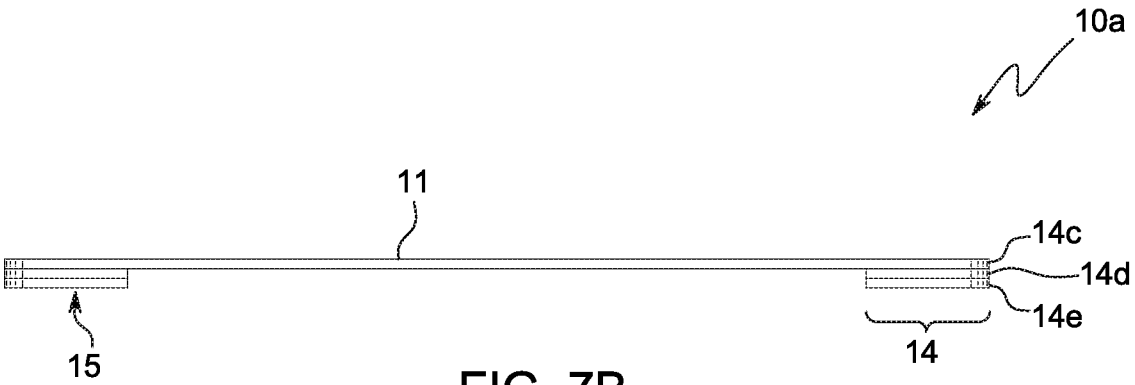
FIG. 7B is a side plan view of a mini loom according to one embodiment of the present disclosure using multiple extremity section layers such as illustrated in FIG. 7A to create the height of the extremity section or warp selection zone.

Referring to FIGS. 6, 7A and 7B, in one embodiment of the mini loom 10*a*, the extremity member 14, along the thickness thereof, comprises a riser section 15 that is divided into three identical layers viz., a base layer 14*c*, a top layer 14*e* and a mid layer 14*d* sandwiched between the base and top layers 14*c* and 14*e*. Each of the layers comprise the aforementioned three arrays 16, 18, 20 disposed thereon wherein, the layers are stacked upon and attached with one another in a manner that maintains the alignment between the arrays. In another embodiment, as can be appreciated from FIG. 7C, the base 11 and riser section 15 are integral with each other, such as by being manufactured as a unitary construction (one-piece molded material, or one-piece machined material). Notably, the number of layers is not limited to three.

FIG. 7B depicts a side view of one embodiment of the present mini loom 10*a* where the raised section 15 comprises multiple layers.

Figure 7C:
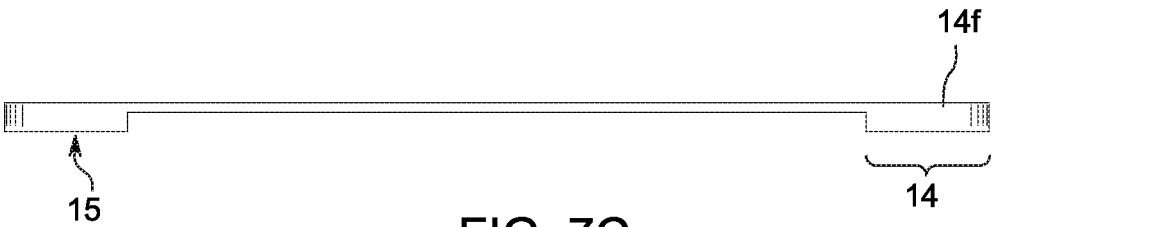
FIG. 7C is a side plan view of a mini loom according to another embodiment of the present disclosure illustrating where the mini loom comprises a unibody, one-piece construction, such as, for example, created by injection molding of a moldable material or machining of a solid stock material.

FIG. 7C depicts a side view of one embodiment of the present mini loom 10*b* where the raised section 15 comprises a unitary layer.

Figure 9:
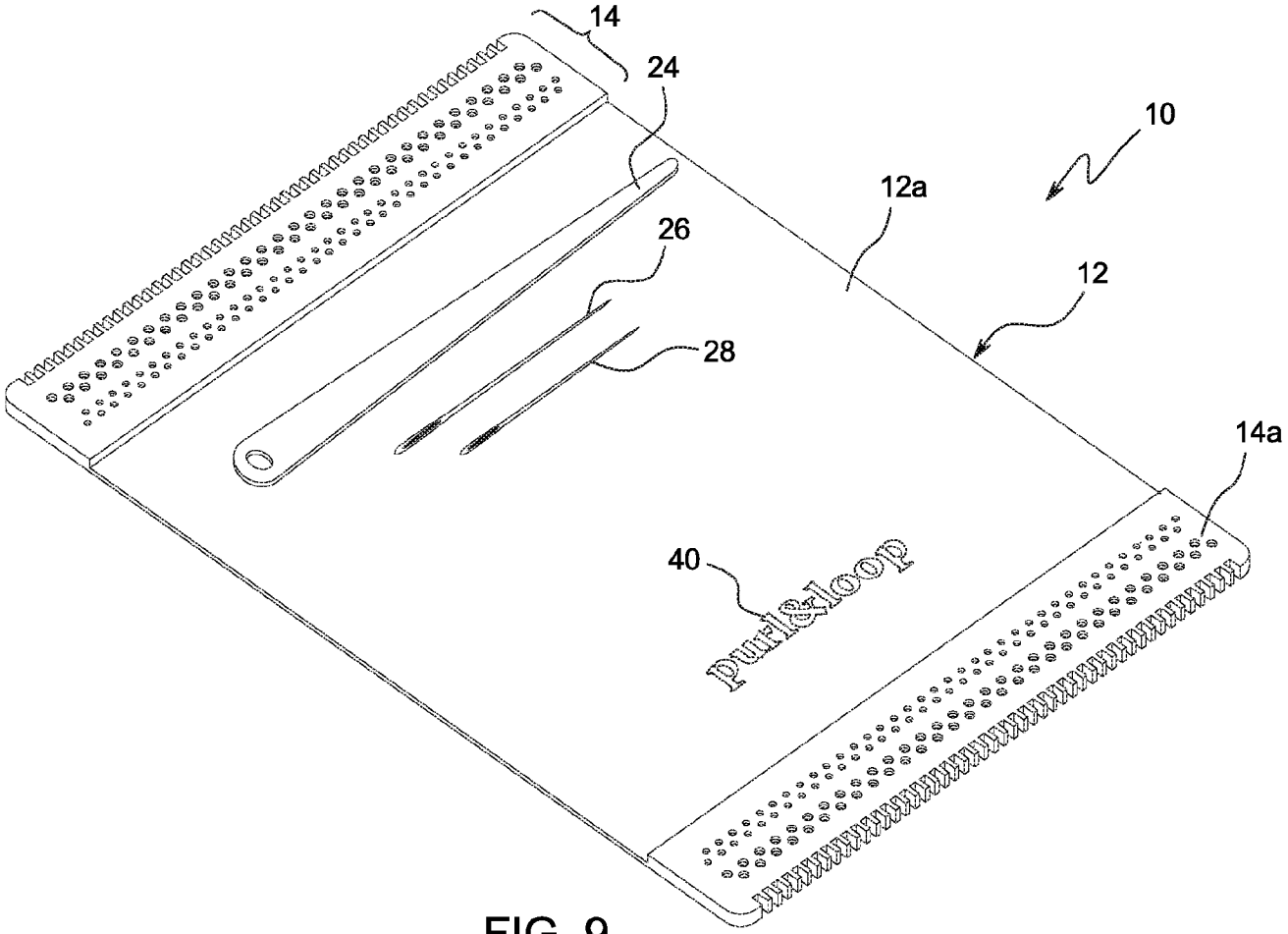
FIG. 9, according to an embodiment of the present invention, is an illustration of a mini loom kit comprising the mini loom, plus threading and weaving needles. A carrying case or bag (not shown) can accompany the kit.

Referring to FIG. 9, commercially, the mini loom 10 may be supplied as a weaving kit with a tapestry needle 24 (such as a wooden tapestry needle variety), weft needle 26 (such as a metal tapestry needle), and a metal warp threading needle 28 (capable of passing through the through holes 18*a*, 20*a*). The threading needle 28 (such as a metal needle) is used in conjunction with threads for warping at 10 and 12 EPIs respectively. Notably, the material of the tapestry needle 24 may be the same as that of the mini loom 10, e.g., wood, plastic, metal or composite. The kit may also include a convenient carrying case or cloth carrying bag (not shown) and instructions for use (not shown).

Figure 11B:
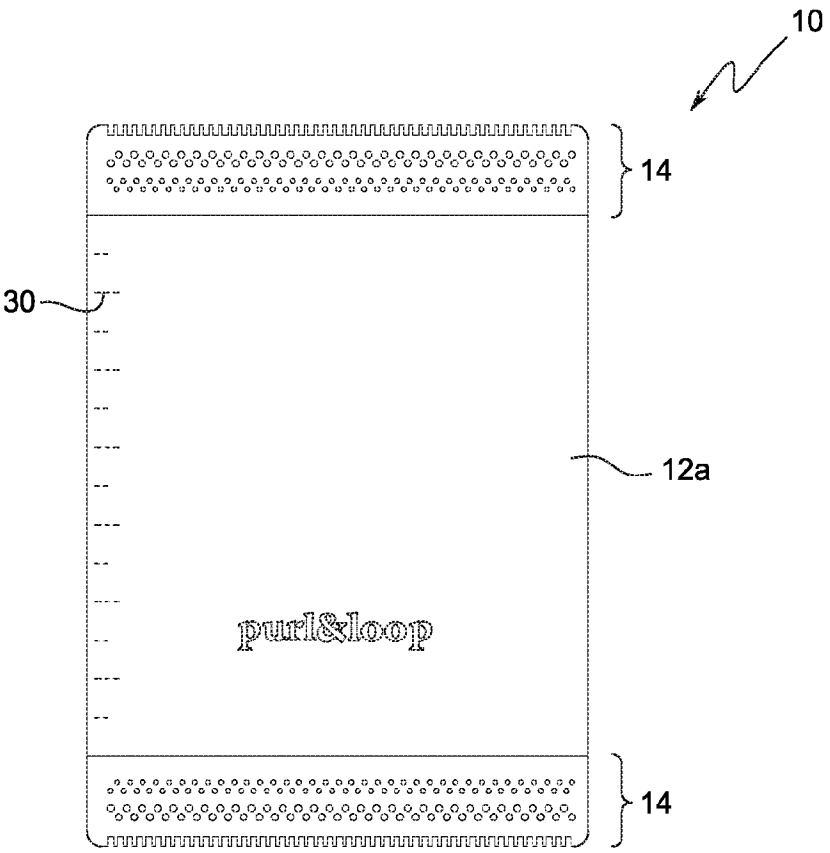
FIG. 11B, according to an embodiment of the present invention, is an illustration of a top plan view of the mini loom of FIG. 3 further configured to show optional ruled markings along a side edge between the extremity sections and further illustrating a variation in the placement pattern for the arrays of desired warp selection holes.
Figure 11A:
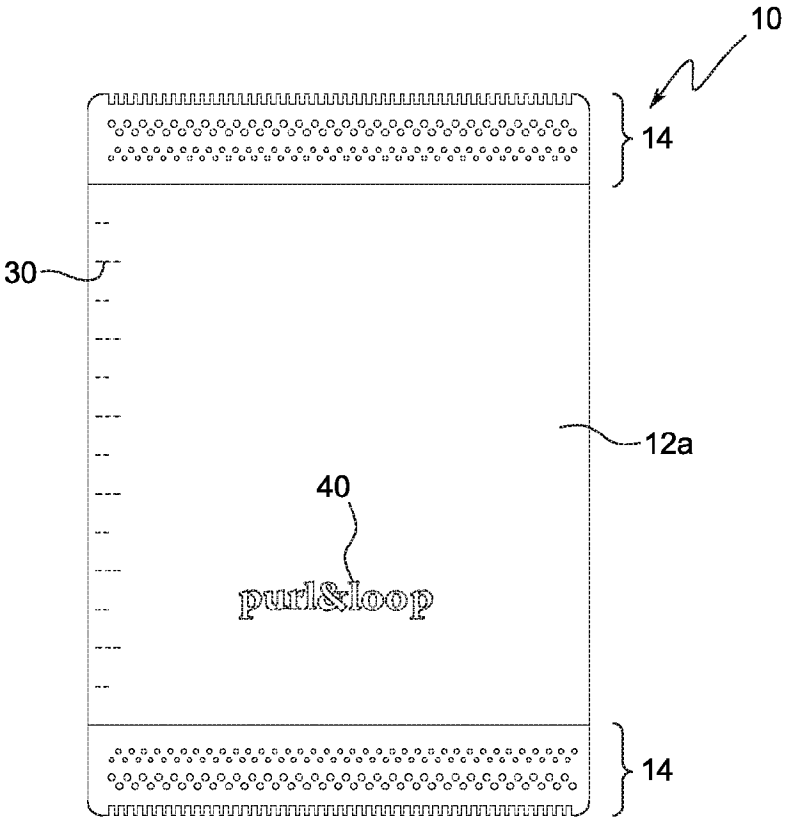
FIG. 11A, according to an embodiment of the present invention, is an illustration of a top plan view of the mini loom of FIG. 3 further configured to show optional ruled markings along a side edge between the extremity sections.

FIGS. 11A and 11B show optional scale markings 30 on a mini loom 10, and also illustrate that the "patterns" created by the array of through holes 18*a*, 20*a* can be varied to achieve the desired EPI. For example, referring to FIG. 11A, the arrangement of the array of holes 18*a*, 20*a* in the EPI zone 14 at one end of the mini loom 10 are depicted as being diametrically opposed to the arrangement of the array of holes 18*a*, 20*a* at the other end of the mini loom 10. As another example, in FIG. 11B, the arrangement of the array of holes 18*a*, 20*a* in the EPI zone 14 at one end of the mini loom 10 are depicted as being the mirror image of the arrangement of the array of holes 18*a*, 20*a* at the other end of the mini loom 10. As will be appreciated by one of ordinary skill having the benefit of the present disclosure, the arrangement of the EPI arrays can be varied to achieve the desired EPI selections within the EPI zone 14.

To illustrate use of the mini loom 10, reference is made to FIGS. 12A-12G. If the weaver desires to create a swatch employing the second or third EPI array (18, 20) (i.e., the arrays created with through holes (18*a*, 20*a*), e.g., 10 or 12 EPI, the first step will be warping the holes 18*a* or 20*a*. FIGS. 12A-12F illustrate use of the mid array 18 of the mini looms of FIG. 1 or FIG. 8B being received with a warp yarn thread 22 in the middle portion of the warp selection section, here, e.g., in the mid array 18 of holes 18*a* creating a warp of 10 EPI, prior to weaving the weft thread 32 through the warp thread 22. The weaver should leave a suitable (here about a 6") tail 22*b* of yarn 22, and create a slip knot loop 22*a*. The loop 22*a* is then placed over the corner of the top left slot 16*a* (relative to when the working face 12*a* is facing up). Using the threading needle 28, the weaver brings the yarn 22 though the first hole 18*a* on the left of the desired second or third, etc. EPI array (for, e.g., 10 or 12 EPI)(here, mid array 18) from the back side 14*b* to the front side 14*a* of the EPI zone 14. The weaver then threads the corresponding hole 18*a* at the bottom of the loom 10 directly beneath the top hole, pulling the yarn supply all the way through this hole. Keeping the yarn 22 under tension, the weaver wraps the yarn 22 around the back of the loom and continues working in this manner, until all the holes are filled across the selected EPI array. If the weaver finds that managing the entire warp supply is cumbersome, the weaver may cut it into thirds. The weaver then warps the first third and then ties the next third to the first using an overhand knot. The knot should be created near the top or bottom of the loom back side 12*b* to allow room to adjust the tension of the loom warp 22 without the knot interfering (i.e., being pulled into one of the array of through holes 18*a*). This completes the threading steps of the warping.

Similarly, if the weaver desires to create a swatch employing the first EPI array 16, e.g., 8 EPI, the first step again will be warping the slots. The weaver should leave a suitable (here, about a 6") tail 22*b* of yarn 22, and create a slip knot 22*a*. The slip knot loop is then placed over the corner of the top left slot (relative to when the working face 12*a* is facing up). With the loom facing the weaver, and keeping the yarn 22 under tension, the weaver starts winding the yarn from top to bottom. The weaver wraps the yarn around the back of the loom and brings it up to the top, placing it in the next slot 16*a*. The weaver works in this manner until all slots are filled.

Figure 12A:
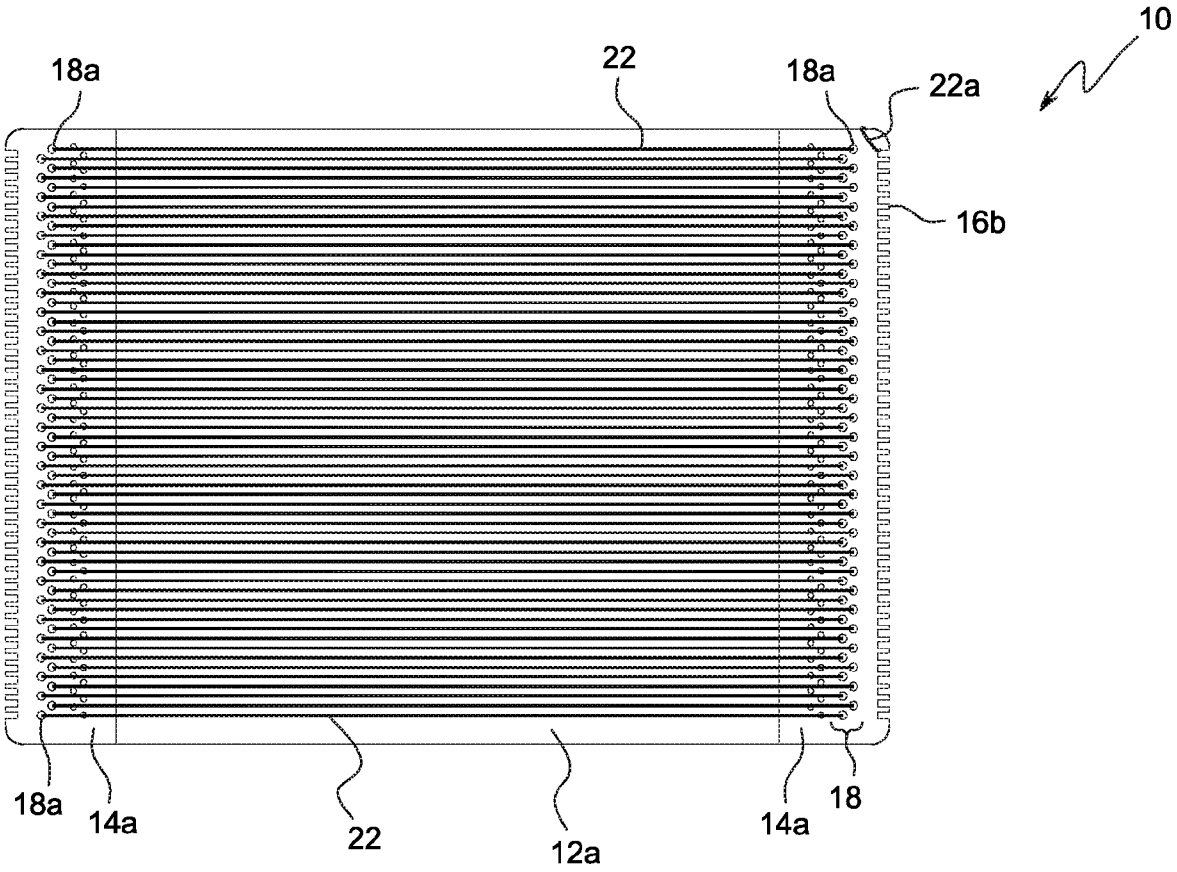
FIG. 12A, according to an embodiment of the present invention, is an illustration of a top plan view of the mini looms of FIG. 1 or FIG. 8B being received with a yarn thread in the middle portion of the warp selection section, here, e.g., an array of holes creating a warp of 10 EPI, prior to weaving the weft thread through the warp.
Figure 12B:
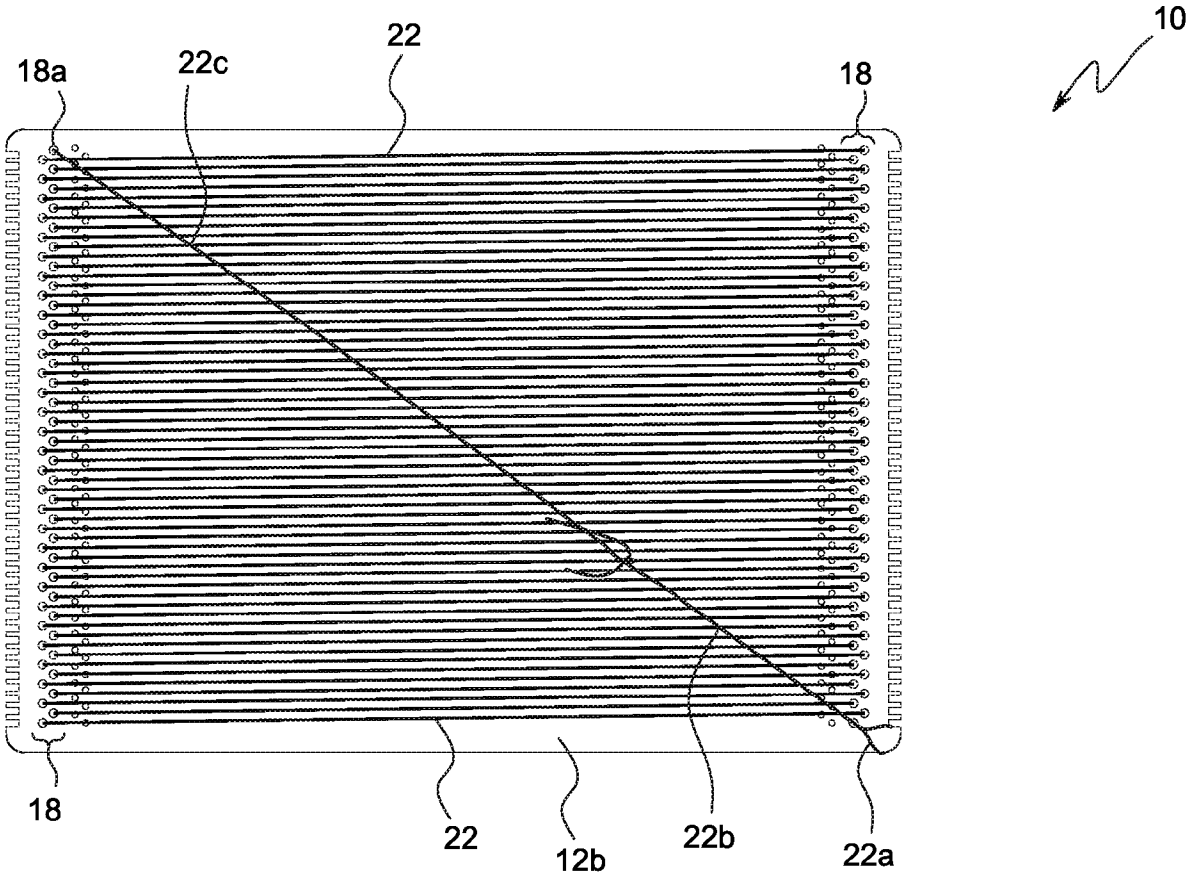
FIG. 12B, according to an embodiment of the present invention, is an illustration of a bottom plan view of the mini loom of FIG. 12A being received with a yarn thread in the middle portion of the warp selection section, here, e.g., an array of holes creating a warp of 10 EPI secured to the mini loom prior to weaving the weft thread through the warp.

Once the weaver has completed the warping on the selected one of the first, second or third EPI arrays (16, 18, 20), the following instructions can apply to the completion of the swatch 52. After the weaver has filled all the holes (18*a*, 20*a*) or slots (16*a*), the weaver should adjust the tension of the warp 22 if necessary. To do this, the weaver should start at the left and gently but firmly pull up on each warp yarn 22 segment working from left to right to eliminate any slack and evenly tension the warp. Referring to FIG. 12B, the weaver should then turn the loom over to have its underside 12*b* facing up and tie the beginning tail 22*b* of the yarn supply to the end of the yarn supply 22*c*, maintaining warp tension as this is performed.

Figure 12C:
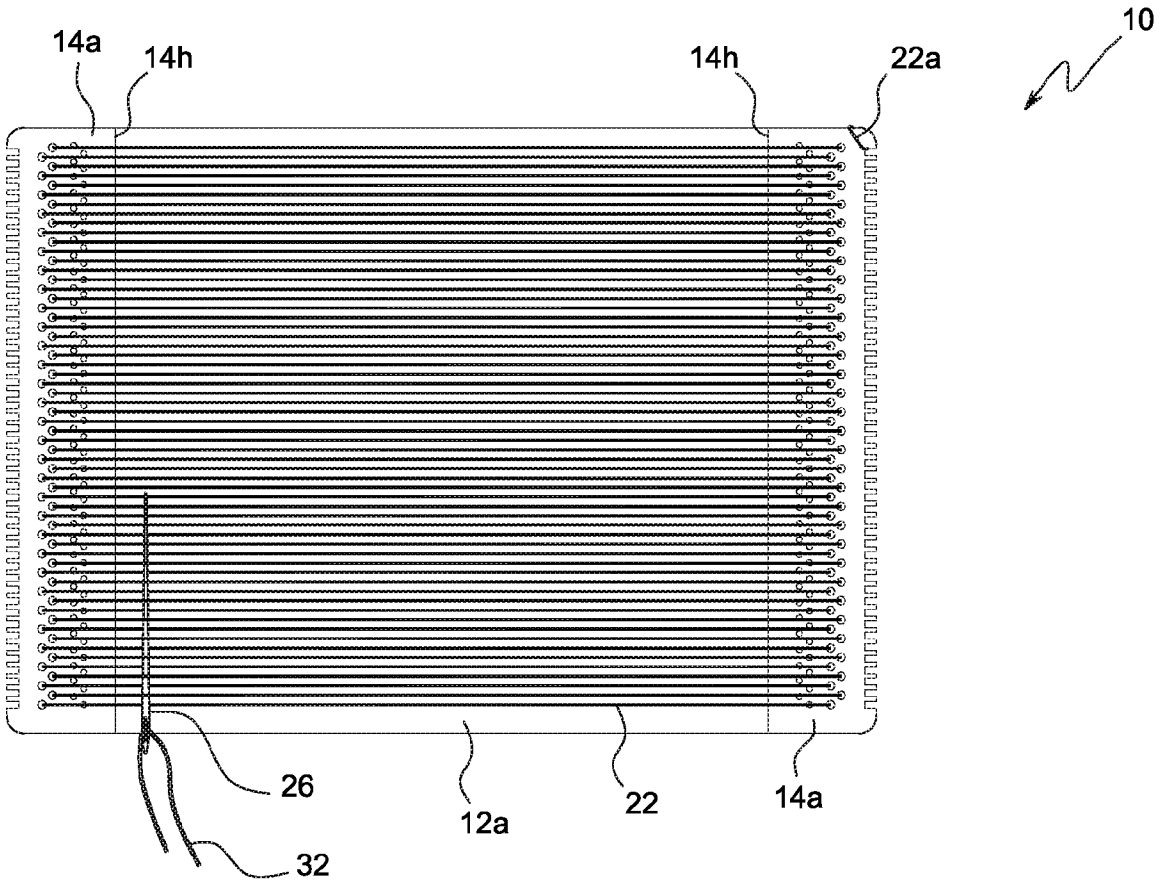
FIG. 12C, according to an embodiment of the present invention, is an illustration of the top plan view of FIG. 12A further showing a needle being used to start weaving the weft thread through the warp thread.
Figure 12D:
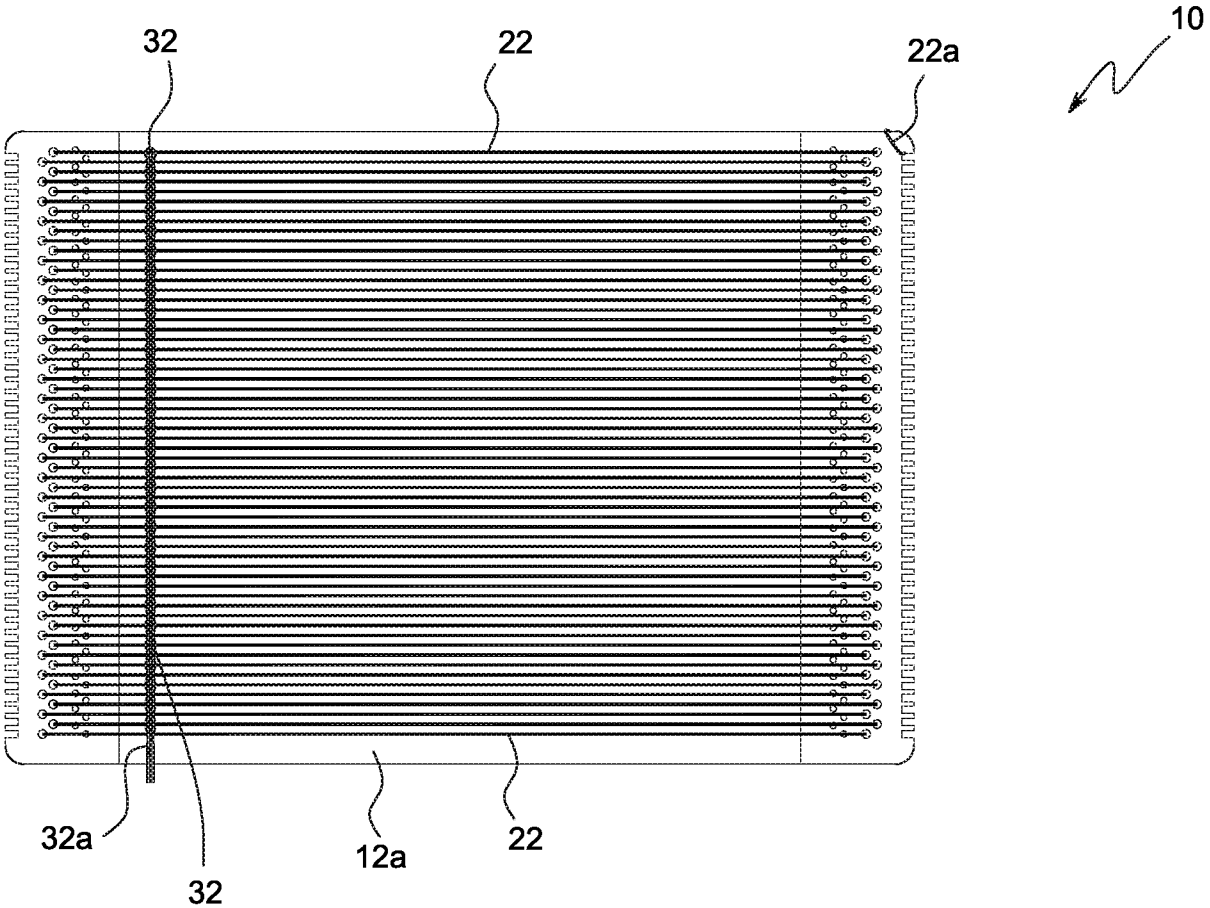
FIG. 12D, according to an embodiment of the present invention, is an illustration of the mini loom of FIG. 12C further showing a few rows of weft thread having been woven through the warp.
Figure 12E:
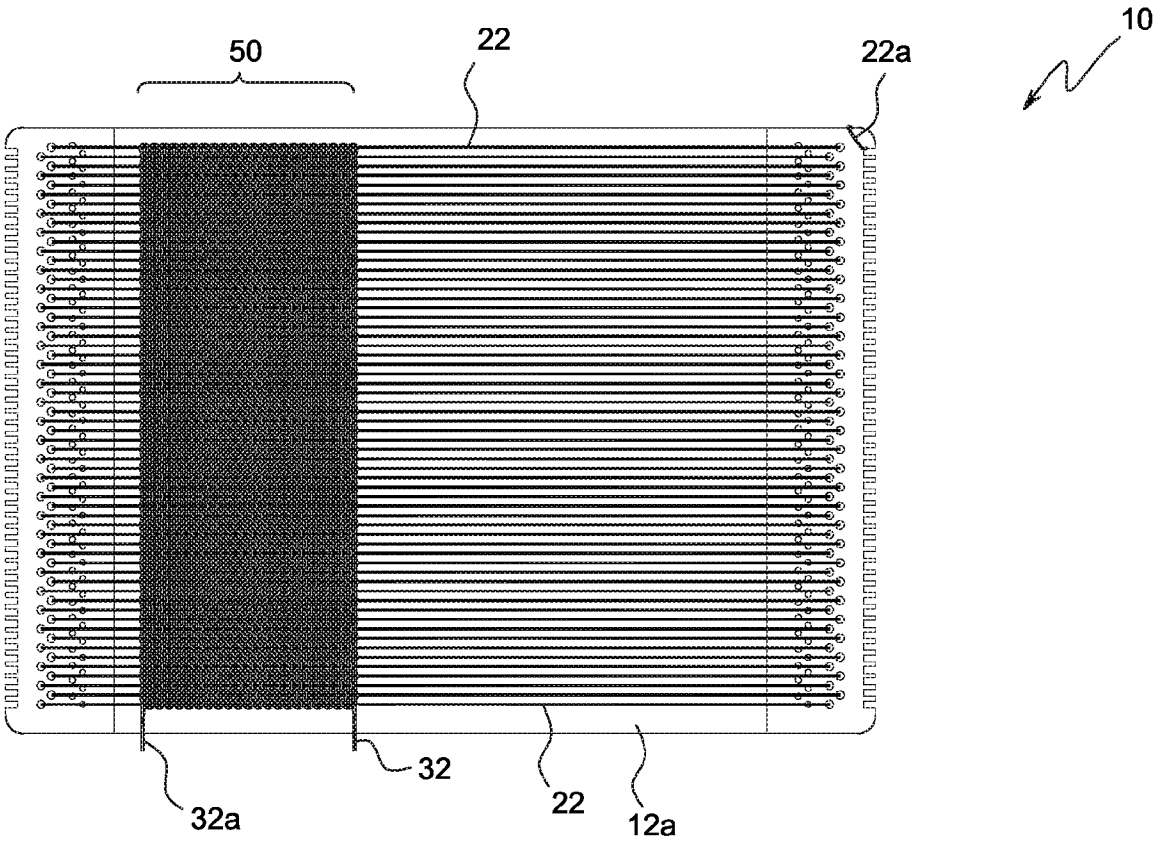
FIG. 12E, according to an embodiment of the present invention, is an illustration of the mini loom of FIG. 12D further showing a partially completed swatch created by weaving the weft thread back and forth/over and under the warp threads.

Once the mini loom is warped, the weaver can then weave the weft 32. Referring now to FIGS. 12C, 12D and 12E, working from one side to the other, the weaver should needle weave (using needle 26 and weft thread 32) in and out of the warp, picking up every other warp yarn 22. The weaver should pull the yarn supply through to the other side of the loom leaving a tail 32*a*. The weft is then adjusted to lay straight by pulling on either end of the yarn 32. The weaver then needle weaves back in the opposite direction picking up every other warp yarn 22 in the opposite order that was performed in the first row (as generally depicted in FIG. 12D). A kitchen fork or other like weaving tool should be used to align the second weft pick with the first weft pick. To maintain a nice tidy edge, the weaver should weave in the weft at a slight angle so that when the weft is pressed into place, the yarn has enough slack to move without pulling at the sides of your weaving causing them to draw in. The weaver can use the ruler 30 on the mini loom 10 to keep the spacing between wefts even. FIG. 12E shows a partially completed swatch 50 being woven on the mini loom 10.

Figure 12F:
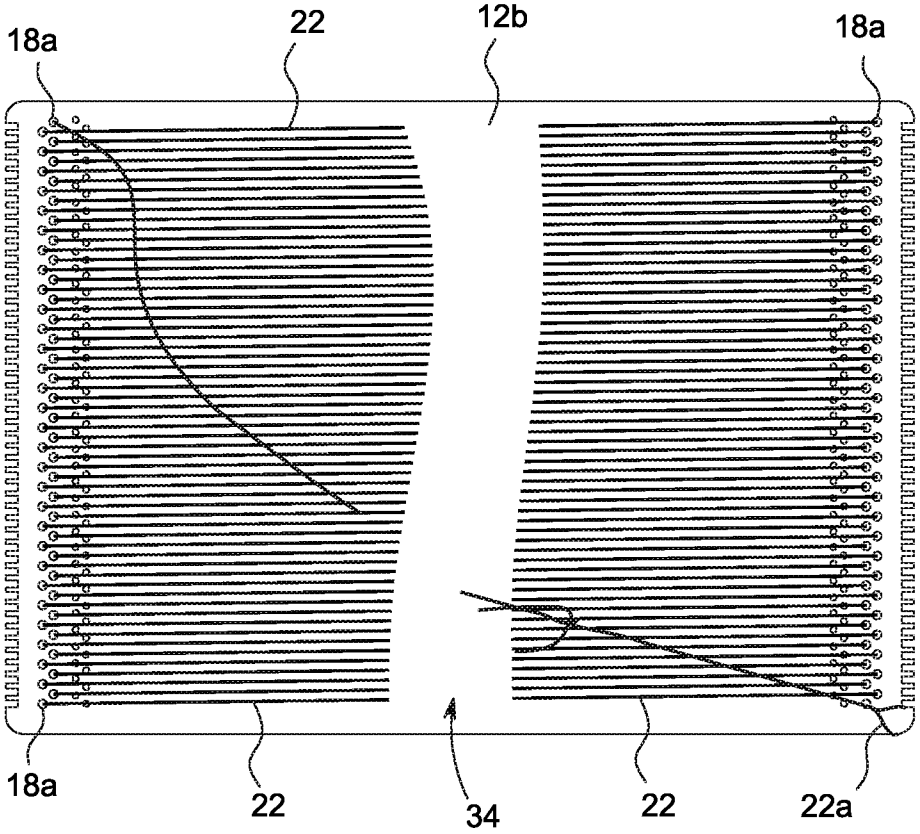
FIG. 12F, according to an embodiment of the present invention, is an illustration of a bottom plan view of the mini loom of FIG. 12E wherein the weft weaving has been completed and the warp threads from the bottom side of the mini loom have been cut to permit removal of the completed swatch from the loom.
Figure 12G:
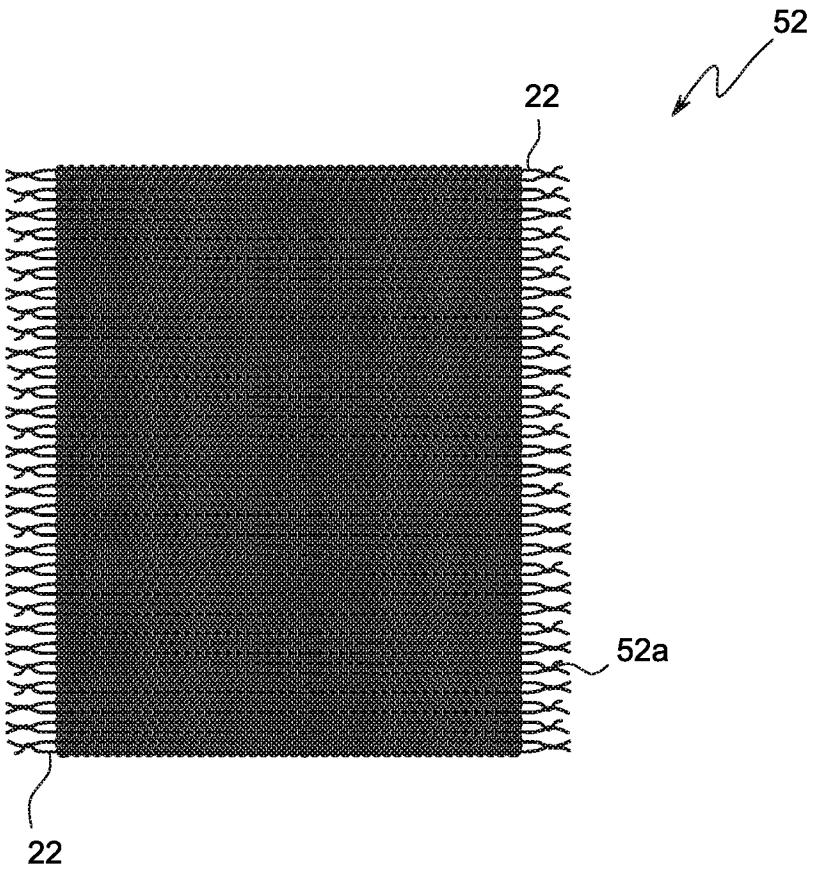
FIG. 12G illustrates a sample swatch (not to scale) created on, and removed from, the mini loom of FIG. 12F wherein adjacent warp threads have been tied together as one representative style of finishing the swatch after removal from the mini loom.

Once the weaving steps are completed, only a few steps remain to finish the swatch. To remove the piece from the loom, turn the mini loom 10 over so that its underside 12*b* is facing up and cut the warp (e.g., across the middle 34 of the back of the warp threads 22 as generally depicted in FIG. 12F). Gently remove the warp threads 22 of the completed swatch 52 from the EPI array slots or holes that were employed (here, holes 18*a*). Using an overhand knot or finishing of the weaver's choosing, the warp ends of the swatch 52 are next secured 52*a* to keep the weft from raveling. The weaver can then needle weave any tails back into the fabric. Using a mild soap and lukewarm water, the weaver can then gently swish the fabric and then let soak for 10 minutes. The swatch 52 (e.g., FIG. 12G) should then be rinsed and permitted to lay flat to dry. The swatch 52 shown in FIG. 12G is not drawn to scale. Typically, if one uses the entire weaving space of the loom 10 across the entire length ($L_2$) according to the embodiment of, e.g., FIG. 12E, the fringe 52*a* would appear along the shorter edge of the swatch. However, as will be understood by those having the benefit of the present disclosure, one can create any desired size swatch within the working space defined by the mini loom working width ($W_2$) and the weaving working space ($L_2$).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. For example, as indicated above, a mini loom could be created with differing EPI selections, and be varied in size. However, all such modifications are deemed to be within the scope of the claims.

All references referred to herein are incorporated herein by reference. While the apparatus, systems and methods of this invention have been described in terms of preferred or illustrative embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art.

I claim:

1. A portable mini loom comprising:

(a) a mid section comprising front and rear surfaces; and (b) a pair of opposingly-disposed, spaced apart, extremity sections, each of which extending from an edge of the mid section, each extremity section comprising front and rear surfaces, each extremity section being thicker than the mid section such that, the front surfaces of the extremity sections are elevated with respect to the front surface of the mid section, each extremity section comprising a plurality of longitudinal, spaced-apart, thread-receiving arrays that are disposed parallel to one another, each thread-receiving array comprising a multiplicity of thread-receiving mechanisms for enabling a thread to be looped therethrough; wherein, each extremity section, along the thickness thereof, is divided into a plurality of layers that are stacked and attached upon one another, each layer comprising the plurality of arrays disposed thereon, the layers stacked such that, the arrays are axially aligned so as to enable the thread to be looped therethrough.

2. The mini loom of claim 1 wherein, the front and rear surfaces of the mid and extremity sections are planar.

3. The mini loom of claim 1 wherein, the mid section is rectangular.

4. The mini loom of claim 1 wherein, the thread comprises a yarn.

5. The mini loom of claim 1 made of wood.

6. The mini loom of claim 1 made of acrylic.

7. The mini loom of claim 1 wherein, the rear surface of the mid section is flush with rear surfaces of the extremity sections.

8. The mini loom of claim 1 being rectangular.

9. The mini loom of claim 1 wherein, the plurality of arrays comprises three arrays, namely, distal, mid, and proximal arrays; the mid array disposed between the distal and proximal arrays.

10. The mini loom of claim 9 wherein, the thread-receiving mechanism of the distal array comprises a series of linearly-arranged cuts made into and along the outer edge of the extremity member; the cuts for receiving the thread therethrough.

11. The mini loom of claim 10 wherein the linearly-arranged cuts are spaced apart to create a warp of 8 Ends Per Inch.

12. The mini loom of claim 9 wherein, the thread-receiving mechanism of the mid array comprises a series of through holes extending between the top and bottom surfaces of the extremity member; the holes for receiving the thread therethrough.

13. The mini loom of claim 12 wherein the holes are spaced apart to create a warp of 10 Ends Per Inch.

14. The mini loom of claim 12 wherein, the holes are arranged in a zigzag fashion.

15. The mini loom of claim 9 wherein, the thread-receiving mechanism of the proximal array comprises a series of through holes extending between the top and bottom surfaces of the extremity member; the holes for receiving the thread therethrough.

16. The mini loom of claim 15 wherein the holes are spaced apart to create a warp of 12 Ends Per Inch.

17. The mini loom of claim 15 wherein, the holes are arranged in a zigzag fashion.

18. The mini loom of claim 1 further comprising ruled markings disposed along an edge of the front surface of the mid section; the scale markings extending between the pair of extremity sections.

19. The mini loom of claim 1 wherein, the plurality of layers comprise a base layer, a top layer, and a mid layer sandwiched between the base and the top layer.

20. The mini loom of claim 19 wherein, the base layer is integral with the mid section.

21. A portable mini loom comprising:

a. a base section having an upper working side surface and an underside surface defining a desired thickness therebetween, opposed first and second end edges defining a desired overall length ($L_1$), and opposed first and second side edges defining a desired overall width ($W_1$);

b. a first Ends Per Inch (EPI) zone disposed proximate the base first end edge and extending inwardly along a desired length ($L_3$) of the overall length ($L_1$), the first EPI zone having an outer first EPI zone edge shared with the base first end edge, an inner first EPI zone boundary opposite the outer first EPI zone edge, an upper first EPI zone working surface on the base working surface, and a first EPI zone underside surface on the base underside surface, the first EPI zone further comprising i. a first distal array of slots disposed along the base first end edge, the slots extending along a desired working width ($W_2$) of the overall width ($W_1$), the slots capable of receiving a warp thread therethrough and being uniformly spaced apart from each other to form spacing defining a first desired warp thread EPI;

ii. a first mid array of through holes disposed across the first EPI zone, the first mid array of through holes extending along the desired working width ($W_2$) of the overall width ($W_1$), the first mid array of through holes capable of receiving a warp thread therethrough and being uniformly spaced apart from each other to form spacing for a second desired warp thread EPI; and iii. a first proximal array of through holes disposed across the first EPI zone, the first proximal array of through holes extending along the desired working width ($W_2$) of the overall width ($W_1$), the first proximal array of through holes capable of receiving a warp thread therethrough and being uniformly spaced apart from each other to form spacing for a third desired warp thread EPI;

c. a second EPI zone disposed proximate the base second end edge and extending inwardly along a desired length ($L_3$) of the overall length ($L_1$), the second EPI zone having an outer second EPI zone edge shared with the base second end edge, an inner second EPI zone boundary opposite the outer second EPI zone edge, an upper second EPI zone working surface on the base working surface, and a second EPI zone underside surface on the base underside surface, the second EPI zone further comprising i. a second distal array of slots disposed along the base second end edge, the slots extending along the desired working width ($W_2$) of the overall width ($W_1$), the slots capable of receiving a warp thread therethrough and being uniformly spaced apart from each other to form spacing for the first desired warp thread EPI;

ii. a second mid array of through holes disposed across the second EPI zone, the second mid array of through holes extending along the desired working width ($W_2$) of the overall width ($W_1$), the second mid array of through holes capable of receiving a warp thread therethrough and being uniformly spaced apart from each other to form spacing for the second desired warp thread EPI;

iii. a second proximal array of through holes disposed across the second EPI zone, the second proximal array of through holes extending along the desired working width ($W_2$) of the overall width ($W_1$), the second proximal array of through holes capable of receiving a warp thread therethrough and being uniformly spaced apart from each other to form spacing for the third desired warp thread EPI;

d. a weaving zone area defined by the working width ($W_2$) along a weaving zone length ($L_2$) extending from the inner first EPI zone boundary to the inner second EPI zone boundary' wherein each of the first distal array of slots disposed along the base first end edge is aligned with a respectively opposed one of the second distal array of slots disposed along the base second end edge; each of the first mid array of through holes disposed across the first EPI zone is aligned with a respectively opposed one of the second mid array of through holes disposed across the second EPI zone; and each of the first proximal array of through holes disposed across the first EPI zone is aligned with a respectively opposed one of the second proximal array of through holes disposed across the second EPI zone.

22. The mini loom of claim 21 wherein the loom is capable of receiving the warp thread to create a warp of the desired first, second or third warp thread EPI, by looping the warp thread, between corresponding slots in the upper working surfaces of the opposed first and second distal arrays, by looping the warp thread between corresponding through holes in the upper working surfaces of the opposed first and second mid arrays, or by looping the warp thread between corresponding through holes in the upper working surfaces of opposed first and second proximal arrays, respectively.

23. The mini loom of claim 22 wherein the first and second EPI zones extend upwardly from the upper working surface of the base to a desired warp clearance height ($H_2$), the first and second EPI zone inner boundaries forming first and second EPI zone inner edges, the distance between the first and second EPI zone inner edges defining a weaving area length ($L_2$).

24. The mini loom of claim 22 wherein the first desired warp thread EPI is 8 EPI, the second desired warp thread EPI is 10 EPI, and the third desired warp thread EPI is 12 EPI.

25. The mini loom of claim 24 wherein the overall length ($L_1$) is approximately 9.25 inches; the overall width ($W_1$) is approximately 6.5 inches; the working width ($W_2$) is approximately 6 inches and the length of the weaving section ($L_2$) is approximately 7 inches.

26. A portable mini loom comprising:

(a) a rectangular mid section comprising planar front and rear surfaces; and (b) a pair of rectangular, opposingly-disposed, spaced apart, extremity sections, each of which extending from an edge of the mid section, each extremity section comprising planar front and rear surfaces, each extremity section being thicker than the mid section such that, the rear surfaces of the extremity sections are flush with the rear surface of the mid section, each extremity section comprising a plurality of longitudinal, spaced-apart, thread-receiving arrays that are disposed parallel to one another, each thread-receiving array comprising a multiplicity of thread-receiving mechanism for enabling a thread to be looped therethrough; wherein, each extremity section, along the thickness thereof, is divided into a plurality of layers that are stacked and attached upon one another, each layer comprising the plurality of arrays disposed thereon, the layers stacked such that, the arrays are axially aligned so as to enable the thread to be looped therethrough.

* * * * *